US010830530B2

(12) United States Patent
Alyanak et al.

(10) Patent No.: US 10,830,530 B2
(45) Date of Patent: Nov. 10, 2020

(54) HOME APPLIANCE DEVICE

(71) Applicant: BSH HAUSGERAETE GMBH, Munich (DE)

(72) Inventors: Altan Alyanak, Istanbul (TR); Gokhan-Hasan Apaydin, Istanbul (TR); Taha Demiroez, Tekirdag (TR); Lars Dinter, Munich (DE); Mustafa Ertik, Tekirdag (TR); Ahmet Fercan, Istanbul (TR); Fidan Gueler, Istanbul (TR); Cemalettin Hastuerk, Tekirdag (TR); Aydin Kutlu, Istanbul (TR); Hueseyin Sen, Tekirdag (TR); Gonca Subasi, Istanbul (TR); Yunus Emre Uyanik, Manisa (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 152 days.

(21) Appl. No.: 15/568,607

(22) PCT Filed: Apr. 18, 2016

(86) PCT No.: PCT/EP2016/058580

§ 371 (c)(1),
(2) Date: Oct. 23, 2017

(87) PCT Pub. No.: WO2016/169899

PCT Pub. Date: Oct. 27, 2016

(65) Prior Publication Data

US 2018/0156534 A1 Jun. 7, 2018

(30) Foreign Application Priority Data

Apr. 21, 2015 (TR) ..... a 2015 04908
Apr. 21, 2015 (TR) ..... a 2015 04910

(51) Int. Cl.
*F25D 25/02* (2006.01)
*F25D 27/00* (2006.01)

(52) U.S. Cl.
CPC ..... *F25D 25/02* (2013.01); *F25D 25/025* (2013.01); *F25D 27/00* (2013.01); *F25D 2317/04131* (2013.01)

(58) Field of Classification Search
CPC ..... F25D 25/025; F25D 25/02; F25D 27/00; F25D 2317/04131; F25D 2317/0413;
(Continued)

(56) References Cited

U.S. PATENT DOCUMENTS 7,147,341 B2 12/2006 Nowak et al.
9,677,806 B2 6/2017 Bischofberger et al.
(Continued)

FOREIGN PATENT DOCUMENTS

CN 2881489 Y 3/2007
CN 100538227 C 9/2009
(Continued)

*Primary Examiner* — Frantz F Jules
*Assistant Examiner* — Martha Tadesse
(74) *Attorney, Agent, or Firm* — Laurence A. Greenberg; Werner H. Stemer; Ralph E. Locher

(57) ABSTRACT

A home appliance device, in particular a home appliance chiller device with improved versatility, includes an inner liner defining a storage space, a container disposed inside the storage space, a manual actuator configured for adjusting humidity inside the container, an illumination unit configured for illuminating an interior of the container and a receptacle at least partly accommodating the manual actuator and the illumination unit. A home appliance, in particular a home chiller appliance including a home appliance device, is also provided.

13 Claims, 16 Drawing Sheets

(58) Field of Classification Search
CPC .... F25D 17/042; F25D 25/005; F25D 25/021; F25D 2400/36; F25D 2317/061; F25D 17/045; F25D 29/005; A47B 2210/175
See application file for complete search history.

(56) References Cited

U.S. PATENT DOCUMENTS

| | | | | |
|---|---|---|---|---|
| 2006/0005567 | A1* | 1/2006 | Lee | F25D 17/045 62/408 |
| 2007/0104841 | A1 | 5/2007 | Min et al. | |
| 2007/0268682 | A1 | 11/2007 | Kim et al. | |
| 2008/0307818 | A1* | 12/2008 | Min | F25D 11/02 62/264 |
| 2009/0066207 | A1* | 3/2009 | Laible | A47B 88/427 312/404 |
| 2009/0199587 | A1 | 8/2009 | Matthews et al. | |
| 2011/0146334 | A1* | 6/2011 | Kim | F25D 17/042 62/441 |
| 2014/0145579 | A1* | 5/2014 | Anderson | F25D 29/005 312/404 |

FOREIGN PATENT DOCUMENTS

| | | | | | |
|---|---|---|---|---|---|
| CN | 102483282 | A | | 5/2012 | |
| CN | 202254596 | U | | 5/2012 | |
| CN | 203464599 | U | | 3/2014 | |
| EP | 1647767 | A2 | | 4/2006 | |
| EP | 2128546 | A1 | | 12/2009 | |
| JP | 2005049093 | A | * | 2/2005 | |
| JP | 2005049093 | A | | 2/2005 | |
| JP | 2008089202 | A | * | 4/2008 | F25D 25/025 |
| JP | 2010048550 | A | | 3/2010 | |
| KR | 100719252 | B1 | * | 5/2007 | F25D 25/025 |
| WO | 2014206807 | A1 | | 12/2014 | |

* cited by examiner

HOME APPLIANCE DEVICE

BACKGROUND OF THE INVENTION

Field of the Invention

The invention relates to a home appliance device, in particular a home appliance chiller device.

US 2007/104841 A1 discloses a home appliance, in particular a home chiller appliance such as a refrigerator, which comprises an inner liner defining a storage space and a shelf which is undetachably fixed to the inner liner and divides the storage space into at least two storage areas. The home appliance further comprises a container arranged inside one of the storage areas below the shelf. Additionally, the home appliance comprises an illumination device arranged at the bottom of the shelf for illuminating an interior of the container.

SUMMARY OF THE INVENTION

The objective of the invention is in particular to provide a home appliance device with improved characteristics regarding versatility. The objective is achieved, according to the invention, by a home appliance device, in a particular a home appliance chiller device, comprising an inner liner defining a storage space, a container disposed inside the storage space, a manual actuator configured for adjusting humidity inside the container, an illumination unit configured for illuminating an interior of the container and a receptacle at least partly accommodating the manual actuator and the illumination unit. Further advantageous implementations and further developments of the invention may be gathered from the dependent claims.

A home appliance device, in a particular a home appliance chiller device, is proposed, comprising: an inner liner defining a storage space; a container arranged inside the storage space; a manual actuator configured for adjusting humidity inside the container; an illumination unit configured for illuminating an interior of the container; and a receptacle at least partly, preferably at least mostly, accommodating the manual actuator and the illumination unit.

The home appliance device may in particular further comprise a frame which is preferably arranged inside the storage space and to which the receptacle is advantageously fixed. The home appliance may in particular further comprise an insert insertable into the storage space, the insert preferably having an accommodation recess, and may in particular further comprise at least one separate fixing unit having a fixing element configured for detachably fixing the insert to the inner liner, wherein the fixing unit is advantageously at least mostly arranged inside the accommodation recess. Furthermore, the manual actuator may in particular comprise a control element, the manual actuator preferably defining at least one lock-in position for the control element, in particular corresponding to at least one humidity level inside the container.

By means of the invention, a versatility of the home appliance device can be increased. Furthermore, a durability of the home appliance device can be increased, as the receptacle protects further units of the home appliance device, which are accommodated inside the receptacle. Also service, maintenance and repair works on the home appliance device may be simplified in particular due to the advantageous arrangement of the manual actuator and preferably of the illumination unit. Furthermore, operability of the home appliance device can be improved, in particular by enhancing a keepability of victuals stored inside the container. In addition a visibility of victuals stored inside the container can be enhanced.

In this context, "configured" is in particular to mean specifically designed and/or equipped. By an object being configured for a certain function is in particular to be understood that the object implements and/or fulfills said certain function in at least one application state and/or operating state. By a "household appliance device" is in particular to be understood at least a portion, preferably a sub-assembly group, of a household appliance. The household appliance is in particular provided for storing and preferably tempering victuals such as beverages, meat, fish, vegetables, fruits, milk and/or dairy products in at least one operating state, advantageously for the purpose of enhancing a keepability of the stored victuals. However the household appliance could also be embodied as a household appliance for warming up and in particular for cooking victuals such as an oven, a steamer and/or a microwave. Advantageously, the household appliance is embodied as a household chiller appliance, which is in at least one operating state configured for cooling victuals. The household chiller appliance could in particular be embodied as a climate cabinet, an ice-box, a refrigerator, a freezer, a refrigerator-freezer combination and/or a wine cooler.

The storage space is in particular a space inside the home appliance device, which is provided for storing victuals. The storage space is in particular at least partly divisible into at least two storage areas, preferably a plurality of storage areas. In an installed state of the home appliance device, the container is in particular arranged movably inside the storage space, in particular inside at least one of the storage areas, and advantageously below the insert, the frame, the receptacle, a closing plate, a shelf and/or a cover of the home appliance device. The container is in particular configured to be arranged at least partly inside the storage space in at least two positions, a first position and a second position. The first position is in particular a storage position, in which the container is preferably configured for storing victuals, and a second position is in particular a use position, in which the container is preferably configured for receiving victuals. The container is in particular embodied as a drawer.

In this context, a "manual actuator" is in particular to be understood as a unit configured for receiving a manual input and preferably configured to adjust a humidity inside the container advantageously at least on the basis of the manual input. The manual input is in particular given via the control element. In order to adjust the humidity the manual actuator may in particular adjust at least one other physical parameter of the container on which the humidity depends, such as a pressure, a temperature and/or an air flow. The receptacle comprises in particular at least one shell, in particular a housing, configured for at least partly, preferably at least mostly and advantageously entirely accommodating at least one further unit of the home appliance device, in particular the manual actuator and/or the illumination unit. The term "at least mostly" with reference to an object is in particular to mean more than 50%, preferably more than 70%, and advantageously more than 90% of a volume, in particular an enclosed volume, and/or a mass of the object.

The illumination unit comprises in particular an illumination device including a light source such as an LED, an OLED and/or a display. In particular in an installed state of the home appliance device, the illumination unit, in particular the illumination device, is preferably at least partly, preferably mostly and advantageously entirely arranged on a bottom of the receptacle and advantageously faces the container. The illumination device is in particular arranged in such a way that the main radiation direction of the illumination device and the main extension plane of the receptacle include an angle between 0° and 90°, preferably between 0° and 45°. A "main extension plane" of an object is, in particular, to be understood as a plane extending parallel to a largest side of an imaginary rectangular cuboid which only just entirely encloses the object and preferably extends through a geometric center of the object.

In this context, a "frame" is in particular to be understood as a separate unit, which in at least one viewing direction, preferably perpendicular to a main extension plane of the frame, at least partly encompasses at least one further unit, in particular the receptacle, of the home appliance device. In this context, "separate" is in particular to mean separate from any other unit of the home appliance device and preferably not implemented integrally with any other unit of the home appliance device. "Implemented integrally" is, in particular, to mean, in this context, connected at least by substance-to-substance bond, e.g. by a welding process, an adhesive bonding, an injection-molding process and/or by another process that is deemed expedient by a person having ordinary skill in the art. Advantageously, implemented integrally could in particular mean made of one piece. "Made of one piece" is, in particular, to mean, in this context, manufactured from one single piece, e.g. by production from one single cast and/or by manufacturing in a one-component or multi-component injection-molding process, and advantageously from a single blank.

In this context, an "accommodation recess" is in particular to be understood as a recess which is at least partly, preferably mostly and advantageously entirely enclosed from at least three, in particular from at least four, sides and which is configured for at least partly, preferably at least mostly and advantageously entirely accommodating the fixing unit. The insert may in particular embodied as a shelf configured for storing victuals, as a bottle holder, and/or as a dividing plate which in an installation state of the home appliance device preferably divides the storage space into at least two storage areas. The insert is preferably configured for adjusting humidity inside the container. Further, the insert comprises advantageously at least one, advantageously a plurality of substructures of the home appliance device such as the receptacle, the manual actuator, the illumination unit, the frame, a cover for the container and/or a closing plate. In this context "detachably" is in particular to be understood as nondestructively and preferably toollessly detachably.

The lock-in position in particular corresponds to a preferably factory-set default level of humidity.

Furthermore, it is proposed that the receptacle is detachably fixed to the frame. In an installed state of the home appliance the receptacle is in particular configured for being removed from the frame at least by sliding the receptacle alongside the frame, preferably at least substantially parallel to a main extension direction of the frame and/or the receptacle. A "main extension direction" of an object is, in particular, to be understood, in this context, as a direction extending parallel to a longest side of an imaginary rectangular cuboid which only just entirely encloses the object. In this context "at least substantially parallel" is in particular to be understood as an orientation of a direction with respect to a reference direction, in particular in a plane, wherein the direction has a deviation from the reference direction in particular of less than 15°, advantageously of less than 10° and particularly advantageously of less than 2°. As a result disassembly can be simplified. In particular service, maintenance and repair works on the home appliance device, preferably on the receptacle and/or on the units accommodated in the receptacle, can be performed advantageously easily.

For the purpose of fixing the receptacle to the frame, it is proposed that the receptacle comprises a deformable latching element and a holding element which has a higher degree of rigidity than the latching element, the latching element and the holding element being configured for fixing the receptacle to the frame. In this context, "deformable" is in particular intended to mean elastically deformable, preferably reversibly deformable and advantageously repeatedly reversibly deformable. In this context, by an object having "a higher degree of rigidity" than another object is in particular to be understood that the objects differ in regard to their deformability preferably due to design and/or material characteristics, such as elastic modulus. Advantageously, the latching element is at least partly deformable in a direction at least substantially perpendicular to the main extension direction of the receptacle and/or the frame. Alternatively or additionally the latching element could be at least partly deformable in a direction at least substantially parallel to the main extension plane of the frame and/or the receptacle. The term "at least substantially perpendicular" is, in particular, intended to define, in this context, an orientation of a direction with respect to a reference direction, wherein the direction and the reference direction, in particular if viewed in one plane, enclose an angle between 80° and 100°, in particular between 85° and 95°, preferably between 88° and 92° and particularly advantageously an angle of 90°. As a result the receptacle can be connected to the frame in a simple manner. In particular an assembly of the home appliance device can be further simplified.

The latching element and/or the holding element may in particular be arranged at an outer wall of the receptacle for the purpose of fixing the receptacle to the frame. In order to avoid additional components and tools for fixing the receptacle and to reduce costs, it is proposed that the receptacle comprises an outer wall which at least partly, preferably at least mostly and advantageously entirely implements the latching element. The latching element is in particular implemented integrally with the outer wall. The latching element comprises in particular a latching hook and a preferably deformable latching arm connected to the latching hook, wherein the latching arm is advantageously at least partly implemented integrally by the outer wall. In particular in a vicinity of the latching element the outer wall is implemented at least partly separate from a base plate of the receptacle. Furthermore, the holding element may in particular be at least partly embodied by the outer wall. The holding element may comprise in particular a wedge-shaped insert element and in particular a notch.

It is further proposed that the receptacle comprises an opening on at least one side through which the manual actuator at least partly extends. The opening extends in particular at least partly, preferably mostly and advantageously entirely over the one side, in particular such that the receptacle is at least partly, in particular at least mostly and advantageously entirely open on the at least one side. In an installed state of the home appliance device the partly open side is an upper side of the receptacle, in particular opposite the base plate of the receptacle. Furthermore, in the installed state of the home appliance device the partly open side faces the closing plate. The receptacle is in particular tray-shaped. Preferably the outer wall of the receptacle is arranged on the base plate and has a height at least substantially greater than a thickness of the base plate. "At least substantially greater"

is intended to mean greater by at least 50%, preferably at least 100% and advantageously at least 150%. In this way an assembly and an arrangement of the manual actuator and/or the illumination unit inside the receptacle can be simplified.

Furthermore, it is proposed that the receptacle, in particular the base plate of the receptacle, comprises at least one pass-through recess on at least one further side, in particular opposite the partly open side, in which the manual actuator, in particular the control element, is at least partly accommodated. Advantageously, the one further side comprises an opening for the illumination device. As a result the manual actuator can be connected to further components which are arranged below the receptacle.

In a preferred implementation of the invention the home appliance device further comprises a closing plate, which is configured for at least partly closing the at least partly open side of the receptacle. The closing plate is in particular embodied as a shelf configured for storing victuals. As a result the receptacle can be sealed against humidity, in particular condensed water and/or spilled fluid, for the purpose of preventing water damage to units accommodated by the receptacle, in particular the manual actuator and/or the illumination unit.

In order to allow a user easy controlling of the manual actuator from above the receptacle, the closing plate comprises a receiving recess configured for at least partly receiving a movable control element, in particular the before-mentioned control element, of the manual actuator.

Moreover, it is proposed that the control element, in particular a surface of the control element, is at least substantially flush with at least one surface of the closing plate. In this context, by "at least substantially flush" is in particular to be understood that a height difference between two objects is less than 2 mm, preferably less than 0.5 mm and advantageously less than 0.13 mm. It can thus be avoided that victuals, e.g. beverages, are placed unsafely on top of the control element, which could lead to water being spilled into the receptacle. Additionally, damage to the control element can be avoided.

In addition, it is proposed that the receptacle comprises a protective inner barrier configured for at least substantially preventing moisture from getting to the illumination unit. The protective inner barrier is in particular arranged inside the receptacle and is preferably distinguishable from an outer wall. The inner barrier extends in particular at least partly from the base plate of the receptacle to the closing plate. This allows preventing moisture damages to the illumination unit.

In an especially preferred implementation of the invention, the receptacle comprises at least two compartments, a first compartment at least partly accommodating the illumination unit and a second compartment at least partly accommodating the manual actuator, wherein the two compartments are at least partly separated by the protective inner barrier. As a result moisture-sensitive electronic parts of the illumination unit can be protected and can in particular be separated from the manual actuator.

Advantageously, the protective inner barrier comprises a drainage channel configured for collecting condensed water. The inner barrier comprises in particular at least two side walls, which at least partly define the drainage channel, a first side wall delimiting the first compartment and a second sidewall facing away from the second compartment. In particular the drainage channel comprises a slope configured for leading the condensed water away from the illumination unit. The inner barrier further comprises in particular a drain, which is connected to the drainage channel and configured for transporting condensed water out of the receptacle. As a result condensed water can be collected and can be specifically conveyed away from electrical components.

In order to adjust the humidity the manual actuator may be configured for adjusting a tempering device, a fan and/or a valve of the container. Advantageously, the container has an opening, wherein the manual actuator is configured for adjusting an opening degree of the opening for the purpose of adjusting the humidity inside the container. In this context, an "opening degree" is in particular to be understood as a percentage of uncovered opening surface of the opening. In particular the manual actuator is connected to a cover of the opening of the container in communicating fashion and is configured for adjusting a movement of the cover with respect to the opening of the container. As a result an air flow between the inside the container and an outside the container, in particular the storage space, is used to easily adjust the humidity.

It is further proposed that the frame comprises a securing recess, which is shaped at least partly corresponding to the latching element, and comprises a holding recess which is shaped at least partly corresponding to the holding element. In particular during an assembly, preferably in an assembly step, the holding recess receives the holding element when the frame and the receptacle are moved towards each other, preferably at least substantially perpendicular to each other. In particular during assembly, preferably in a further assembly step, the securing recess catches the latching element when the frame and the receptacle are moved alongside each other, preferably at least substantially parallel to each other. In an assembled state the securing recess is in particular configured for locking the latching hook of the latching element in place. In particular during disassembly, preferably in a disassembly step, the securing recess releases the latching element when the latching element is pushed towards the receptacle. In particular during disassembly, preferably in a further disassembly step, the holding recess releases the holding element when the frame and the receptacle are moved alongside each other, preferably at least substantially parallel to each other. As a result, an assembly and/or a disassembly can be simplified.

In a preferred implementation of the invention, the holding recess has an insert portion configured for receiving the holding element, in particular the insert element, and a holding portion for fixing the holding element, in particular the notch, in a form-fit manner. As a result an assembly and/or a disassembly can be further simplified.

Advantageously, it is proposed that the frame is detachably fixed to the inner liner. As a result an assembly and a disassembly can be further simplified and repair works on the receptacle can be performed easily.

In another aspect of the invention in particular for the purpose of having different quality features configured for a home appliance device, a first module for the home appliance device is proposed, comprising: the manual actuator configured for adjusting the humidity inside the container; and the receptacle, which at least partly accommodates the manual actuator and is fixable to the frame. Herein the first module is preferably free of any kind of illumination unit preferably configured for illuminating the interior of the container. In particular, in this context, a second module for the home appliance device is proposed, comprising: the manual actuator configured for adjusting the humidity inside the container; the illumination unit configured for illuminating the interior of the container; and the receptacle, which at least partly accommodates the illumination unit and at least partly accommodates the manual actuator and is fixable to the frame.

Based on selection of respectively the first or the second module a home appliance device can be equipped with different quality features such as the manual actuator and/or the illumination unit. In order to achieve a home appliance device having different quality features, in a further aspect of the invention a construction kit for constructing a home appliance device is proposed, comprising the frame; the first module and the second module. Furthermore, the construction kit may in particular comprise at least two, preferably a plurality of, first modules and/or in particular at least two, preferably a plurality of second modules. As a result a versatility of the home appliance can be increased.

For manufacturing a home appliance device having different quality features, in an additional aspect of the invention a method for manufacturing the home appliance device, in particular using the construction kit, is proposed, the method comprising the steps of: providing the frame; providing the first module; providing the second module; and fixing either the first module or the second module to the frame. In particular a method for manufacturing a set of home appliance devices, in particular using the construction kit, is proposed, the method comprising the steps of: providing a set of frames; providing a set of first modules; providing a set of second modules; and fixing either at least one first module of the set of first modules or at least one second module of the set of second modules to at least one frame of the set of frames.

It is also proposed that the fixing element is configured for fixing the insert to the inner liner when the insert is, preferably at least partly, at least mostly and advantageously entirely, pushed into the storage space in a push-in direction of the insert. In this context, a "push-in direction" is in particular to be understood as a direction, which is in an installed state of the home appliance device at least substantially parallel to a horizontal plane of the home appliance device and which points towards a rear side of the inner liner. Advantageously, in a fixed position of the insert the fixing element blocks any movement of the insert at least in a pull-out direction and/or in the push-in direction. In this context, a "pull-out direction" is in particular to be understood as a direction which, in an installed state of the home appliance device, is at least substantially parallel to a horizontal plane of the home appliance device and which points away from the rear side of the inner liner. As a result the insert can be fixed to the inner liner in an easy manner.

For the purpose of fixing the insert advantageously fixedly to the frame, the fixing element is at least substantially hook-shaped. An object is in particular "at least substantially hook-shaped" if it comprises at least a head portion which is arranged angled to a main extension direction of the object. In particular the fixing element comprises a head portion which is angled to a main extension direction of the fixing element, wherein preferably an obtuse angle between the head portion and the main extension direction of the fixing element is at least 270° and/or at most 360°.

Further, it is proposed that the accommodation recess comprises a receiving opening configured for receiving the fixing unit in assembly. The accommodation recess comprises in particular the receiving opening on a side facing, in an installed state of the home appliance device, a side wall of the inner liner. As a result the fixing unit can be arranged inside the accommodation recess in a simple manner.

In addition, it is proposed that the accommodation recess comprises a pass-through opening through which the fixing element passes when fixing the insert to the inner liner. The accommodation recess in particular comprises the pass-through opening on a side facing, in an installed state of the home appliance device, a bottom or a top wall of the inner liner. The receiving opening is in particular at least substantially larger than the pass-through opening. As a result the insert can be mechanically fixed to the inner liner in a simple manner.

In an implementation of the invention, it is proposed that the receiving opening and the pass-through opening are connected. As a result the fixing unit can be arranged inside the accommodation recess even more easily.

For the purpose of separating the assembly of the fixing unit and the fixing function of the fixing unit, the receiving opening and the pass-through opening have opening directions which are at least substantially perpendicular to each other.

It is further proposed that, the insert comprises an assembly element inside the accommodation recess, which is configured at least for connecting the fixing unit to the insert. The assembly element in particular comprises a pin which preferably has a snap member configured for fixing the fixing unit in particular in a direction at least substantially parallel to the opening direction of the receiving opening. This allows connecting the fixing unit to the insert in a simple manner.

In a preferred implementation of the invention the fixing unit comprises a bearing element which is connected to the assembly element, in particular to the pin, and is configured for pivoting the fixing element about a pivot axis. The pivot axis is in particular at least substantially parallel to the opening direction of the receiving opening. Advantageously, the pivot axis is a symmetry axis of the pin and/or of the bearing element. The pin and the bearing element form in particular a bearing unit.

In a preferred implementation of the invention, it is proposed that the fixing unit comprises an elastic element for counteracting a rotation of the fixing element about the pivot axis. An "elastic element" is in particular to be understood as an element which is configured to be elastically deformable. In this way it is achievable that the insert is connected to the inner liner semi-automatically.

The elastic element may be embodied as a spiral spring, a torsion spring and/or a coil spring. Advantageously, in order to implement the elastic element in a compact and simple manner, the elastic element is embodied as a bow-spring.

In addition, it is proposed that the home appliance device further comprises a snap edge coupled to the inner liner and configured for connecting with the fixing element. Preferably the snap edge is arranged on a side wall of the inner liner. The home appliance device may comprise a directing element which is configured for directing the insert in the push-in direction when the insert is inserted into the storage space. The directing element can in particular comprise the snap edge. Furthermore the directing element is arranged at a side wall of the inner liner and is in particular implemented integrally with the inner liner. Advantageously the directing element is embodied as a rail. This allows fixing the insert to the inner liner semi-automatically.

In an especially preferred implementation of the invention, it is proposed that the insert comprises the frame, which defines the accommodation recess, the frame being provided for connecting further substructures of the insert. Further, the frame comprises in particular the assembly element of the insert. As a result, substructures of the insert can be advantageously connected to the inner liner via the frame.

Further, it is proposed that the fixing unit is embodied as a one-piece unit. In this context, a "one-piece unit" is in particular to be understood as an element which is implemented separately from other units and which is made of one piece. This advantageously allows dispensing with further components.

In a preferred implementation of the invention, it is proposed that the manual actuator comprises a guiding element, which guides a movement of the control element and prevents at least one degree of freedom, preferably at least two degrees of freedom, of the control element. In this context, a "degree of freedom" is in particular to be understood as a possibility of movement of the control element in a spatial direction. As a result manual controlling of the manual actuator can be simplified.

In addition it is proposed that the guiding element prevents the movement of the control element in at least one direction which is at least substantially parallel to a horizontal plane of the home appliance device in an installation position. Furthermore, the guiding element in particular prevents, in an installed state, a movement of the control element in at least one direction which is at least substantially perpendicular to a horizontal plane of the home appliance device. In particular, the guiding element limits all but one degree of freedom. The guiding element is in particular embodied as a rail. In particular the guiding element limits a movement of the control element in a movement direction to a certain length. Furthermore, the guiding element is advantageously configured to function as a stop for the control element. As a result a poka-yoke-effect for controlling of the manual actuator can be achieved.

In order to achieve an on-off impression for a user controlling the manual actuator, it is proposed that the control element is configured to be nondestructively released from the lock-in position if a force acting on the control element exceeds a holding force holding the control element in the lock-in position. The force acting on the control element is in particular directed at least substantially in the movement direction of the control element.

In a preferred implementation of the invention, it is proposed that, the manual actuator comprises at least one snap element configured for locking the control element in the lock-in position. As a result the lock-in position can be configured in a simple manner.

In addition it is proposed that the snap element is deformable in a direction at least substantially perpendicular to a movement direction of the control element. The snap element is in particular deformable in a direction at least substantially parallel to the horizontal plane of the home appliance device. Advantageously, in the lock-in position the snap element applies a force to the control element, which holds the control element in the lock-in position. This advantageously allows dispensing with further components for providing the force holding the control element in the locking position.

It is further proposed that the snap element comprises a first guiding chamfer and a second guiding chamfer, the first guiding chamfer being configured for contacting the control element and deforming the snap element in case of a movement of the control element in a first movement direction, and the second guiding chamfer being configured for contacting the control element and deforming the snap element in case of a movement of the control element in a second movement direction opposite the first movement direction. The guiding chamfers in particular respectively include an angle with the movement direction of the control element between 0° and 90°, preferably between 0° and 75° and advantageously between 0° and 45°. Hereby deformation of the snap element can be simplified. In particular, based on the angle between the chamfer and the movement direction of the control element, a resistance of the lock-in position can be set.

Advantageously, it is proposed that the guiding element and the snap element are implemented integrally with each other. This advantageously allows dispensing with further components.

It is further proposed that the manual actuator comprises at least one further snap element, which is located opposite the snap element, in particular with respect to a main extension direction of the guiding element. The further snap element is implemented in particular mirror-inverted with respect and preferably at least substantially identical to the snap element. In this context, "at least substantially identical" is to mean formed identically apart from tolerances and/or production errors. This advantageously allows dispensing with further components.

In a preferred implementation of the invention, the further snap element is deformable in a direction counter to a direction in which the snap element is deformable, in particular in a main extension direction of the guiding element. As a result the control element can be locked in the lock-in position even more safely. In addition, the further snap element can be used as an additional security measure if the snap element fails or even breaks.

In addition it is proposed that the lock-in position corresponds to a maximum humidity level inside the container. The maximum humidity level in particular corresponds to a minimum opening degree of the opening of the container. In particular, the minimum opening degree is reached when the surface of the opening is at least mostly and advantageously entirely covered. As a result the humidity inside the container can be capped to a factory-set maximum.

In a preferred implementation of the invention, the manual actuator defines at least one further lock-in position. The lock-in position and the further lock-in position are in particular situated at different ends of the guiding element. As a result the manual actuator can be equipped with factory-set default values regarding humidity.

In an especially preferred implementation of the invention, the further lock-in position corresponds to a minimum humidity level inside the container. The minimum humidity level in particular corresponds to a maximum opening degree of the opening of the container. Advantageously, the maximum opening degree is reached when the surface of the opening of the container is at least mostly and advantageously entirely uncovered. As a result the humidity inside the container can be capped to a factory-set minimum.

The home appliance device is herein not to be limited to the application and implementation described above. In particular, for the purpose of fulfilling a functionality herein described, the home appliance device can comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing exemplary embodiments of the invention are shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and the description. The description of this specimen may be correspondingly transferred to the other specimens of the object.

DESCRIPTION OF THE INVENTION

Figure 1:
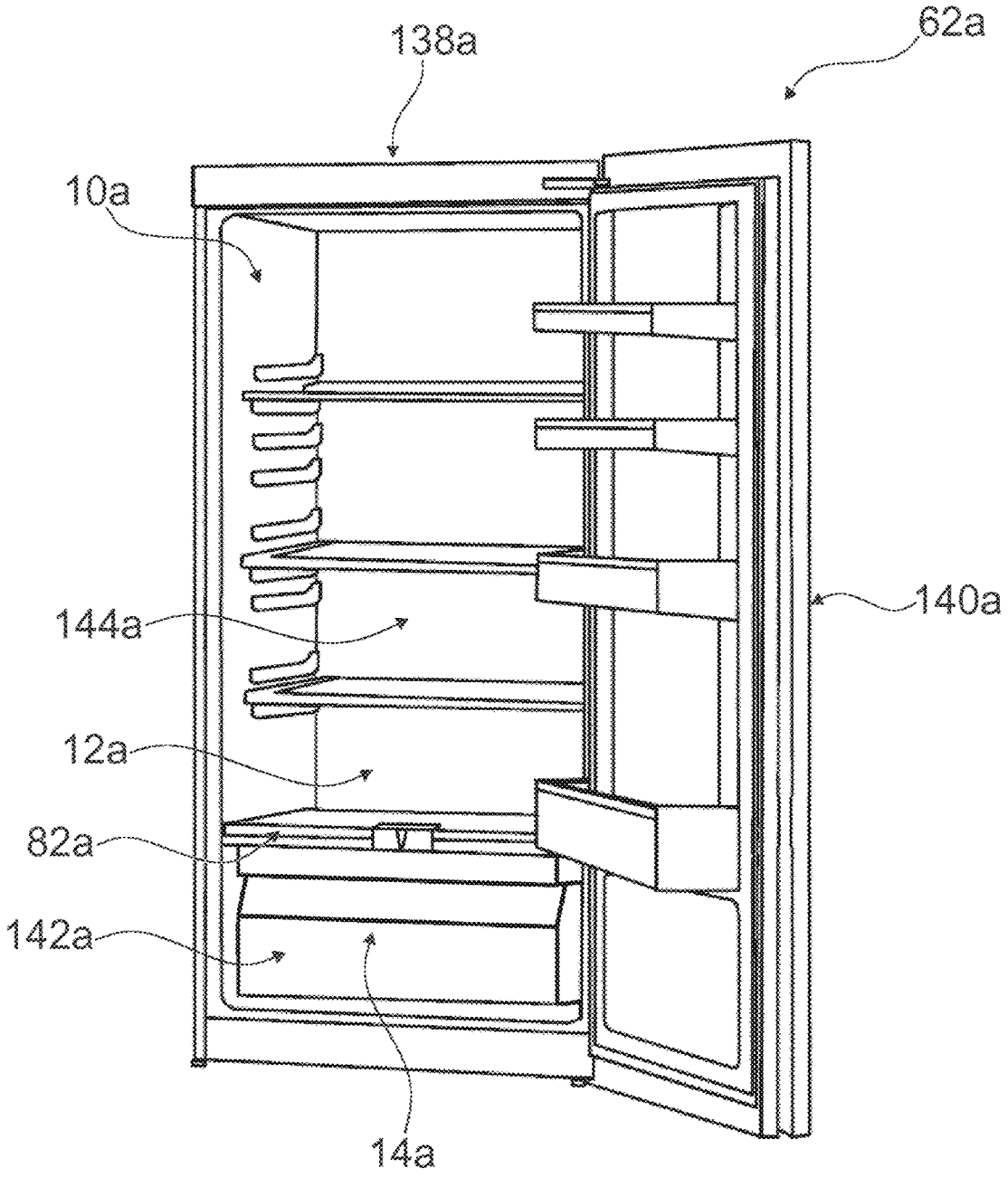
FIG. 1 a home appliance comprising a home appliance device in a schematic front view, FIGS. 2, 3 an insert and a container of the home appliance device in an exploded and in a cross-sectional view, FIG. 4 the insert and the container in an exploded view, FIG. 5 a portion of the insert comprising an illumination unit in a perspective view, FIGS. 6-10 portions of the home appliance device comprising a frame and a fixing unit in different views, FIGS. 11-14 a further embodiment of a home appliance device comprising a frame and a receptacle in different views, FIG. 15 a construction kit for constructing a home appliance device comprising a first module and a second module in a schematic view, FIG. 16 a method for constructing the home appliance device of FIG. 11 in a schematic view, FIGS. 17-19 a further embodiment of a home appliance device comprising a receptacle and a frame in different views, FIGS. 20-27 a further embodiment of a home appliance device comprising a frame and a receptacle in different views, FIGS. 28-30 a further embodiment of a home appliance device comprising a receptacle in different views, FIGS. 31, 32 a further embodiment of a home appliance device comprising a manual actuator in exploded views, and FIG. 33 a further embodiment of a home appliance device with a manual actuator in an exploded view.

FIG. 1 shows a home appliance 62*a* comprising a home appliance device in a schematical front view. The home appliance 62*a* is embodied as a refrigerator. The home appliance 62*a* could further be embodied as a climate cabinet, an ice-box, a freezer, a refrigerator-freezer combination and/or a wine cooler. Alternatively the home appliance 62*a* may be a home appliance for warming up and in particular cooking victuals, such as an oven, a steamer and/or a microwave. The home appliance device comprises an outer housing 138*a*. The home appliance device comprises an inner liner 10*a*. The inner liner 10*a* is arranged inside the housing 138*a*. The home appliance device comprises a storage space 12*a*. The inner liner 10*a* defines the storage space 12*a*. The home appliance device comprises a door 140*a* for closing the storage space 12*a*. The storage space 12*a* is divided into at least two storage areas 142*a*, 144*a*, namely a first storage area 142*a* and a second storage area 144*a*. The first storage area 142*a* is configured for storing victuals which are sensitive to humidity, e.g. vegetables and fruits. The second storage area 144*a* is configured for storing victuals which are packaged and/or insensitive to humidity.

The home appliance device comprises a container 14*a*. The container 14*a* is in at least one operating state at least partly arranged inside the storage space 12*a*, in particular inside the first storage area 142*a*. The container 14*a* is arranged movably inside the storage space 14*a* and is in particular extractable from the storage space. The container 14*a* is arrangeable in at least two positions, a first position and a second position. The first position is a storage position. In the first position, the container 14*a* is configured for storing victuals. The second position is a use position. In the second position, the container 14*a* is configured for receiving victuals. In FIG. 1 the container 14*a* is arranged in the first position. The container 14*a* can be made of plastic, in particular a transparent plastic, and/or of metal.

Figure 2:
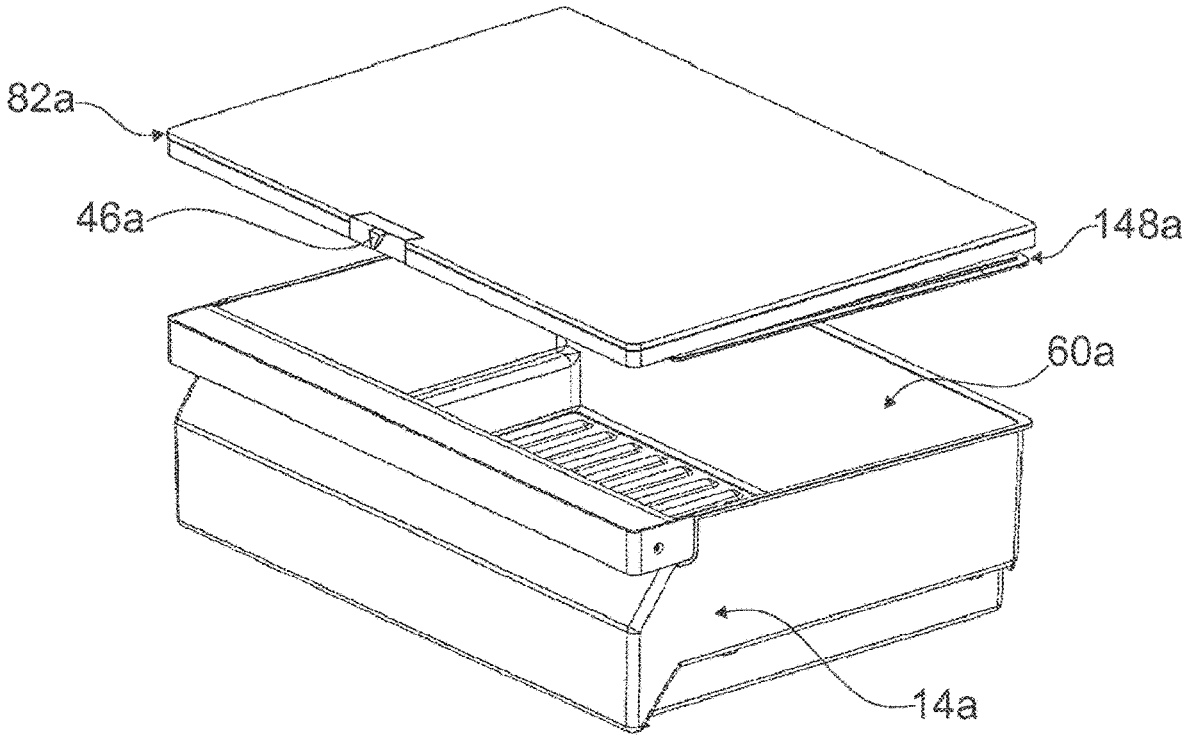
Figure 3:
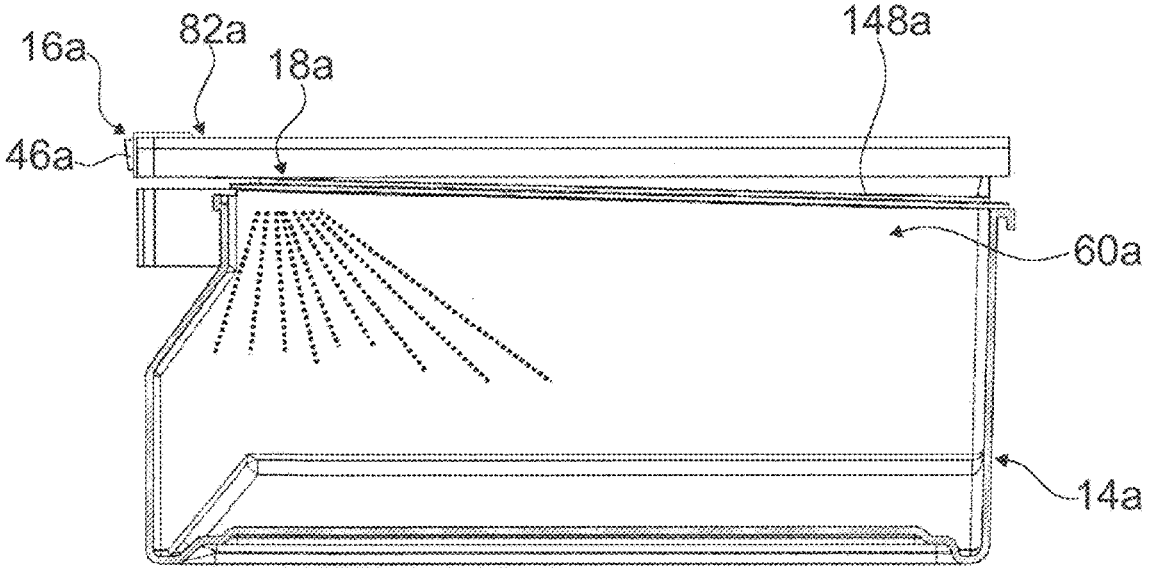

FIGS. 2 and 3 show a portion of the home appliance device comprising an insert 82*a* and the container 14*a* in an exploded and in a cross-section view. The container 14*a* comprises an opening 60*a*. The opening 60*a* is configured for receiving victuals for storage inside the container 14*a* and/or for granting access to the victuals stored inside the container 14*a*. In an installation position, in particular in the first position of the container 14*a*, the opening 60*a* of the container 14*a* faces toward a ceiling of the inner liner 10*a*. The container 14*a* is embodied as a drawer. The container 14*a* may be embodied as a bin and/or as a box or as any other type of receptacle configured for receiving and storing victuals deemed advantageous by someone skilled in the art. Alternatively or additionally the container 14*a* may comprise a further opening, which differs from the opening 60*a* of the container 14*a*, and is in particular configured for receiving victuals for storage inside the container 14*a* and/or for granting access to the victuals stored inside the container 14*a*. In this case the home appliance device comprises only one container 14*s*. Additionally the home appliance device may comprise a deviating number of containers 14*a* as deemed advantageous by someone skilled in the art.

The insert 82*a* is insertable into the storage space 12*a*. The insert 82*a* is detachably fixed to the inner liner 10*a*. The insert 82*a* divides the storage space 12*a* into the two storage areas 142*a*, 144*a* (see FIG. 1). In this case the insert 82*a* is embodied as a dividing plate. Alternatively or additionally the insert 82*a* may be embodied as a shelf and/or as a bottle holder. The insert 82*a* is configured for adjusting humidity inside the container 14*a*. The insert 82*a* comprises a plurality of substructures of the home appliance device. In an installation position, in particular in the first position of the container 14*a*, the opening 60*a* of the container 14*a* faces the insert 82*a*.

The home appliance device comprises the manual actuator 16*a*. The manual actuator 16*a* is accommodated inside a receptacle 20*a* of the home appliance device. The manual actuator 16*a* is configured for adjusting humidity inside the container 14*a*. The manual actuator 16*a* adjusts an air flow between an inside of the container 14*a* and an outside of the container 14*a*, in particular the storage space 12*a*. The manual actuator 16*a* is configured for adjusting an opening degree of the opening 60*a* of the container 14*a* for the purpose of adjusting the humidity level inside the container 14*a*, in particular by moving a cover 148*a* of the insert 82*a* with respect to the container 14*a* (see FIGS. 2,3 and 4). The opening degree is correlated to a degree of uncovered surface area of the opening 60*a* of the container 14*a*. Alternatively or additionally the manual actuator 16*a* could adjust a pressure and/or a temperature. The manual actuator 16*a* is further configured to adjust the humidity based on a manual input. To provide a manual input, the manual actuator 16*a* comprises a control element 46*a*. The control element 46*a* is movable.

Figure 4:
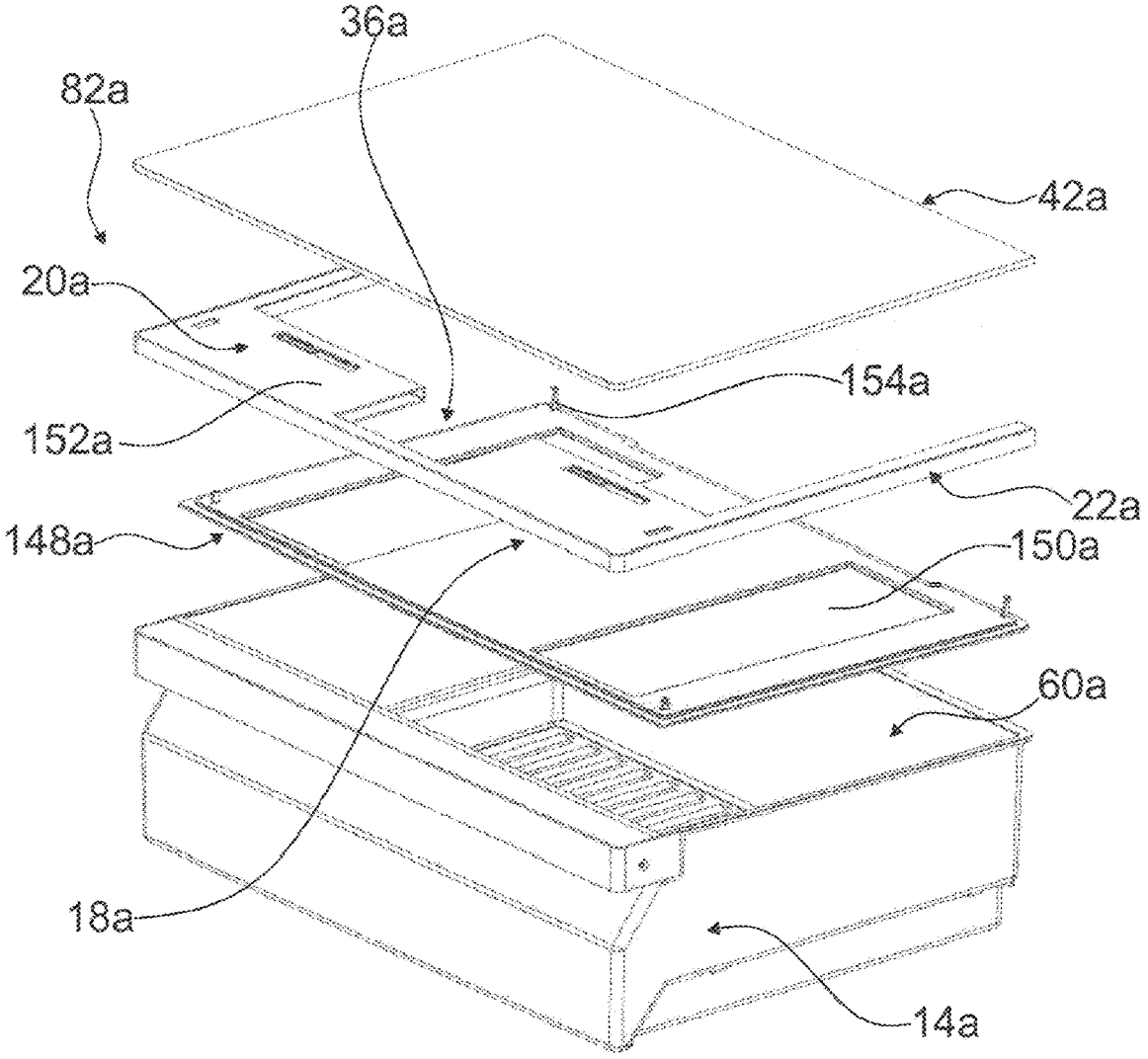

FIG. 4 shows the insert 82*a* and the container 14*a* in an exploded view. The cover 148*a* is configured for at least partly closing the opening 60*a* of the container 14*a*, in particular in order to adjust humidity inside the container 14*a*. Furthermore, the cover 148*a* is configured for allowing radiation of light into and/or out of the container 14*a*. For this purpose the cover 148*a* may be at least partly, preferably mostly and advantageously entirely translucent and preferably transparent. The cover 148*a* may comprise a window 150*a* configured for allowing radiation of light into and/or out of the container 14*a*. The window 150*a* is made of an at least translucent and preferably transparent material. The window 150*a* is shaped rectangularly. The window 150*a* extends over at least 20% of the main extension of the cover 148*a*. The window 150*a* is arranged below an illumination unit 18*a* of the home appliance device, in order to allow light emitted by the illumination unit 18*a* to radiate into an interior of the container 14*a*. In this case the cover 148*a* comprises two windows 150*a*. Viewed in a direction perpendicular to a main extension direction of the cover 148*a*, the windows 150*a* are arranged on opposite sides. The windows 150*a* are arranged mirror-symmetrically to each other. Alternatively or additionally the home appliance device may comprise a deviating number of windows as deemed advantageous by someone skilled in the art. The cover 148*a* is movably coupled to a frame 22*a* of the home appliance device.

The insert 82*a* comprises the frame 22*a*. The frame 22*a* comprises a guiding unit. The guiding unit is configured for coupling the frame 22*a* with the cover 148*a*. The guiding unit comprises at least one guiding profile. The guiding profile couples the cover 148*a* in such a way that it is movable with respect to the frame 22*a* (see FIGS. 3 and 4). The guiding profile is arranged on a lateral section of the frame 22*a*, which in particular flanks a side wall of the inner liner 10*a* in an installation position. In this case the frame 22*a* comprises four guiding profiles. The cover 148*a* comprises a coupling element 154*a*. The coupling element 154*a* engages into the guiding profile. The coupling element 154*a* is arranged in a vicinity of a corner of the cover 148*a*. The coupling element 154*a* is embodied as a hanger. In this case the cover 148*a* comprises four guiding elements 154*a*, in particular one guiding element 154*a* for each guiding profile, which are advantageously arranged in a vicinity of each corner of the cover 148*a*. The cover 148*a* and the frame 22*a* are arranged angled to each other (see FIG. 4). The cover 148*a* is in at least one operation state, in particular when the cover 148*a* closes the opening 60*a* of the container 14*a*, entirely, at least substantially, parallel to the opening surface of the container 14*a* (see FIG. 3).

In an installation position, the frame 22*a* is arranged inside the storage space 14*a*. Furthermore, in the installation position, the frame 22*a* is detachably fixed to the inner liner 10*a*. The frame 22*a* is separate from any other unit of the home appliance device. The frame 22*a* is configured for connecting further substructures of the insert 82*a* to each other. Viewed in a direction perpendicular to the frame 22*a*, the frame 22*a* at least partly encompasses at least one further unit of the home appliance device, in particular the receptacle 20*a* of the home appliance device.

The insert 82*a* comprises the receptacle 20*a*. In an installation position, the receptacle 20*a* is detachably fixed to the frame 22*a*. The receptacle 20*a* is configured for accommodating at least one further unit of the home appliance device. The receptacle 20*a* comprises a shell 152*a*. Inside the shell 152*a* the further unit is accommodated. The shell 152*a* is in particular embodied as a housing. The receptacle 20*a* is at least partly open on at least one side 36*a*. In an installed state of the home appliance device, the at least partly open side 36*a* is an upper side of the receptacle 20*a*. The at least partly open side 36*a* is covered by a closing plate 42*a* of the home appliance device. The receptacle 20*a* can be made of plastic and/or of metal.

The insert 82*a* comprises the closing plate 42*a*. The closing plate 42*a* is in particular embodied as a shelf, which is in particular configured for storing victuals. The closing plate 42*a* is connected to the frame 22*a* of the insert 82*a*. The frame 22*a* carries the closing plate 42*a*.

Figure 5:
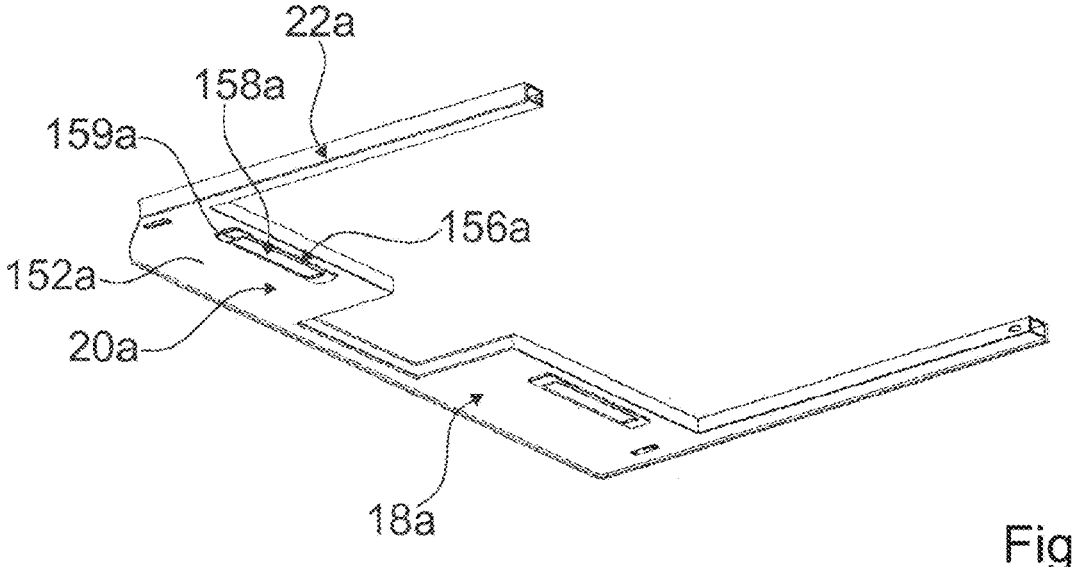
Figure 6:
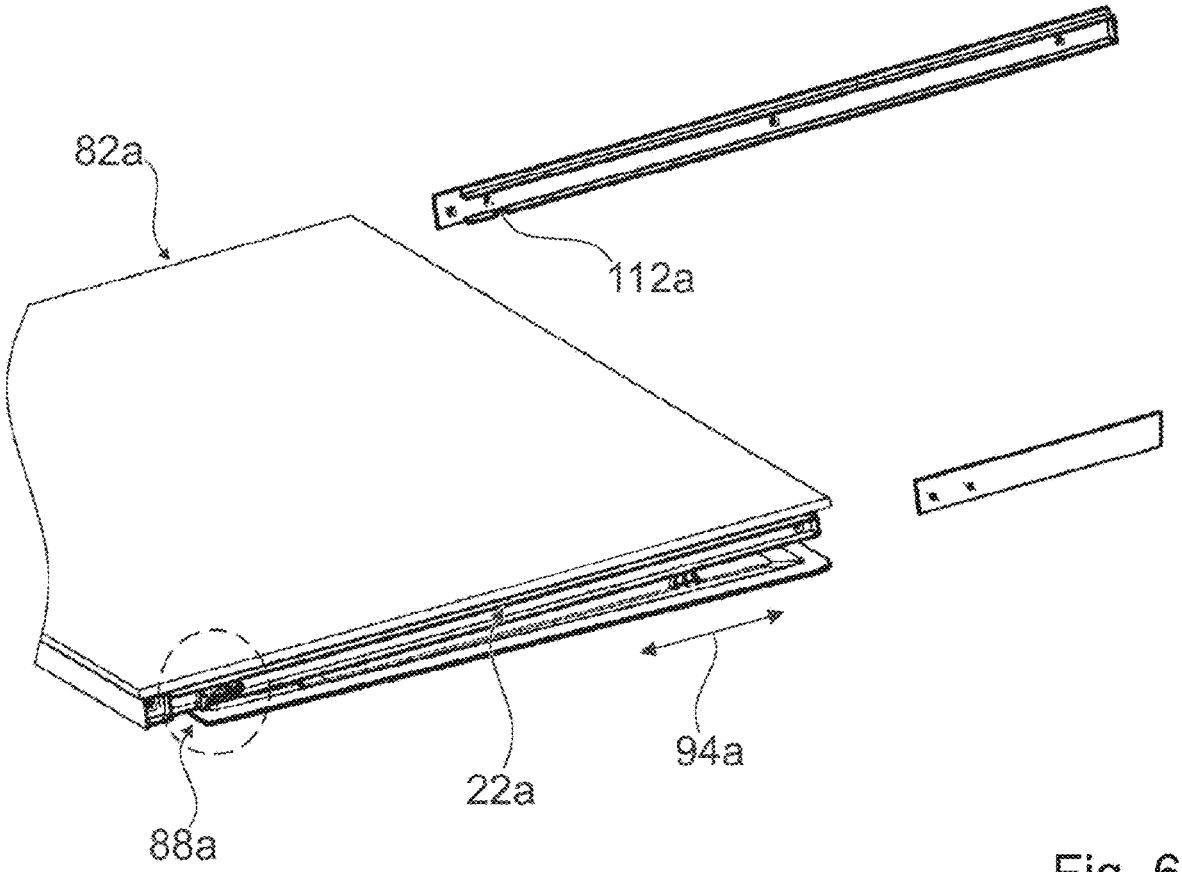
Figure 7:
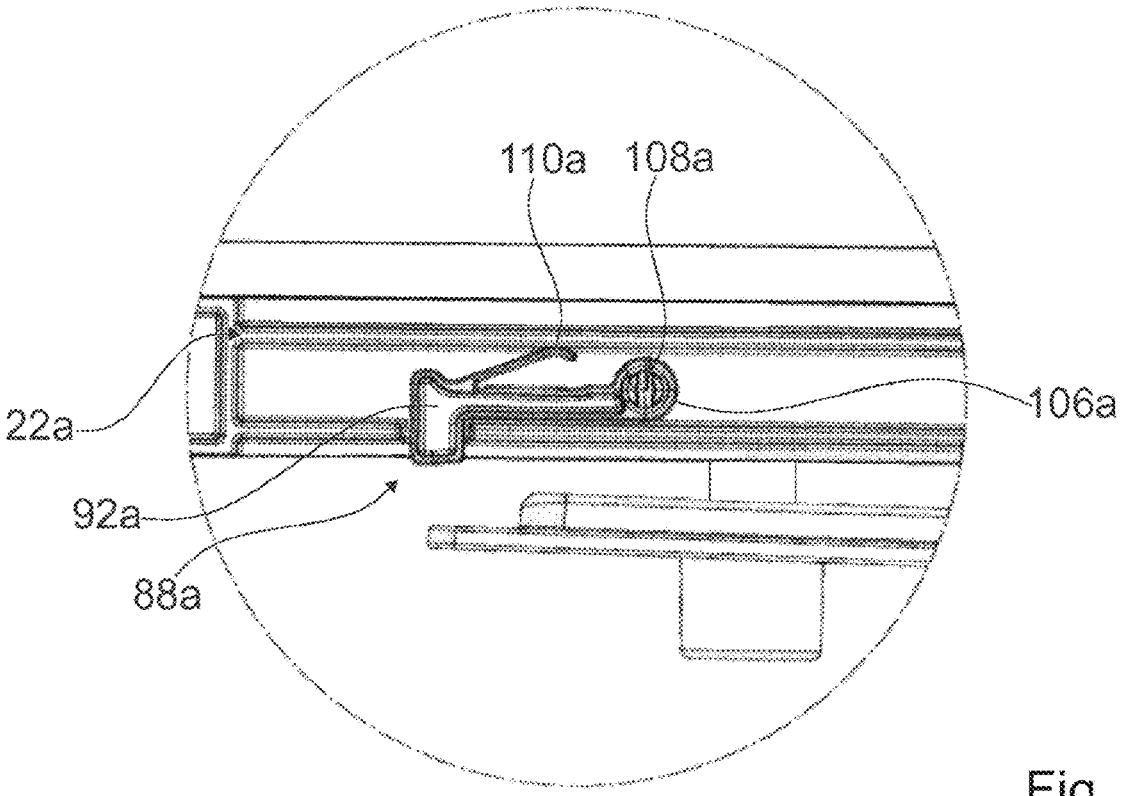
Figure 8:
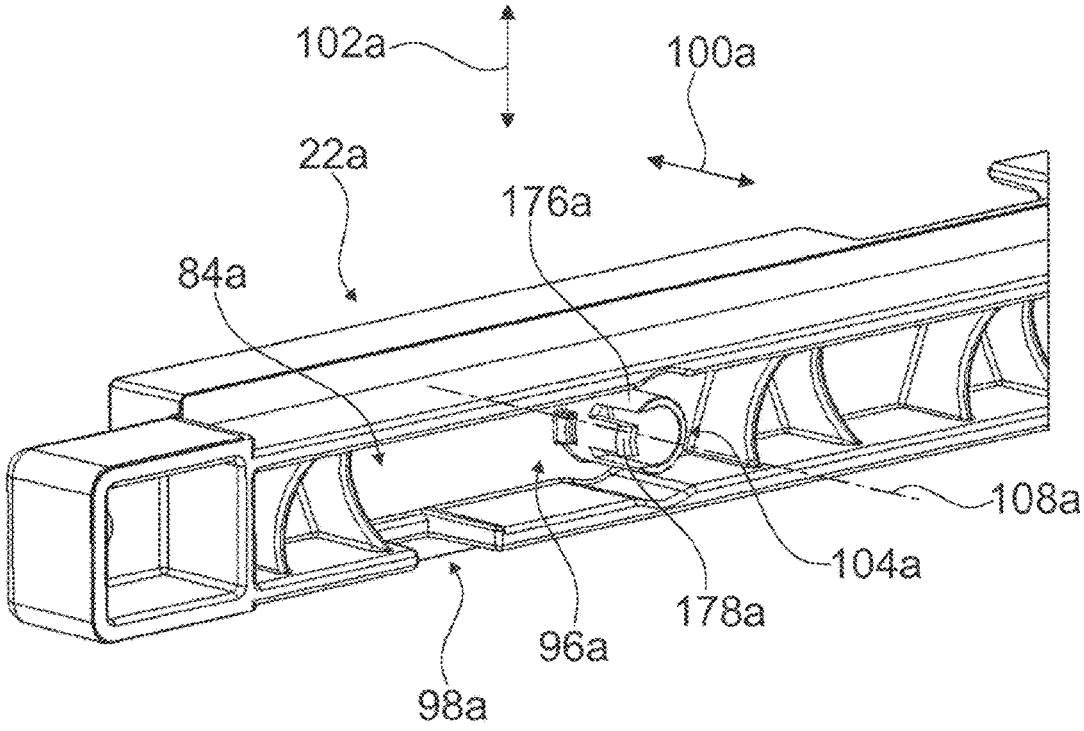
Figure 9:
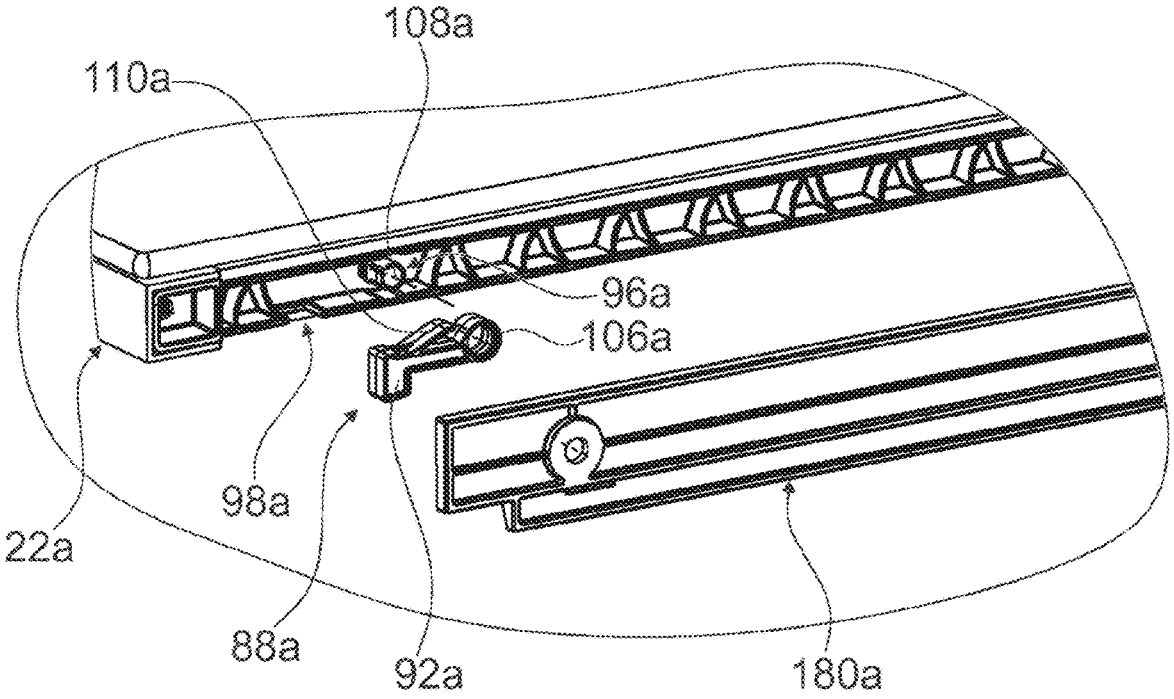

FIG. 5 shows the frame 22*a* and the receptacle 20*a* with the illumination unit 18*a* of the home appliance device in a perspective view. The illumination unit 18*a* is configured for illuminating an interior of the container 14*a*. The illumination unit 18*a* is accommodated inside the receptacle 20*a*, in particular inside the shell 152*a*. The illumination unit 18*a* comprises an illumination device 156*a*. The illumination unit 18*a* comprises in particular a printed circuit board on which the illumination device 156*a* is arranged. The illumination device 156*a* comprises a light source. The light source is in this case embodied as an LED. Alternatively or additionally the light source 152*a* may be embodied as an OLED and/or as a display. The illumination device 156*a* faces the container 14*a*. The illumination device 156*a* is arranged in such a manner that the main radiation direction of the illumination device 156*a* and a horizontal plane, in particular the main extension plane of the receptacle 20*a*, form an angle between 0° and 90°. The receptacle 20*a* comprises an illumination opening 158*a* on a lower side of the receptacle 20*a*. The illumination device 156*a* radiates light through the illumination opening 158*a* into the interior of the container 14*a*. The receptacle 20*a* comprises in particular an illumination cover 159*a*. The illumination cover 159*a* is configured for protecting the illumination device 156*a*. The illumination cover 159*a* is at least partly translucent and preferably transparent. Alternatively or additionally the receptacle 20*a* may be at least partly translucent and preferably transparent. The illumination unit 18*a* comprises two illumination devices 156*a*. Viewed in a direction perpendicular to a main extension direction of the receptacle 20*a*, the illumination devices 150*a* are arranged on opposite sides of the receptacle 20*a*.

FIGS. 6 to 10 show a portion of the home appliance device in different views. The home appliance device comprises at least one separate fixing unit 88*a* (see FIG. 9). The insert 82*a* is fixable to the inner liner 10*a* by means of the fixing unit 88*a*. The insert 82*a* comprises an accommodation recess 84*a*. The frame 22*a* defines the accommodation recess 84*a* (see FIG. 8). The accommodation recess 84*a* is at least partly enclosed from at least three sides by the frame 22*a*. The accommodation recess 84*a* is configured for at least partly accommodating the fixing unit 88*a*. The accommodation recess 84*a* comprises a receiving opening 96*a* configured for receiving the fixing unit 88*a* in assembly. In an installed state of the home appliance device, the receiving opening 96*a* faces a side wall of the inner liner 10*a*. Furthermore, the accommodation recess 84*a* comprises a pass-through opening 98*a*. In an installed state of the home appliance device, the pass-through opening 98*a* faces a bottom wall of the inner liner 10*a*. The receiving opening 96*a*, in particular an opening surface of the receiving opening 96*a*, is in particular at least substantially larger than the pass-through opening 98*a*, in particular an opening surface of the pass-through opening 98*a*. The receiving opening 96*a* and the pass-through opening 98*a* are connected on one side. The receiving opening 96*a* and the pass-through opening 98*a* have opening directions 100*a*, 102*a* which are at least substantially perpendicular to each other. The insert 82*a* comprises two accommodation recesses 84*a* which are, viewed in a direction perpendicular to the main extension of the insert 82*a*, on opposite sides of the insert 82*a*.

The insert 82*a* comprises an assembly element 104*a*. The assembly element 104*a* is implemented integrally with the frame 22*a*. The assembly element 104*a* is accommodated inside the accommodation recess 84*a*. The assembly element 104*a* is at least configured for connecting the fixing unit 88*a* to the insert 82*a*. The assembly element 104*a* comprises a pin 176*a*. The pin 176*a* has a snap member 178*a*. The snap member 178*a* is configured for fixing the fixing unit 88*a* to the insert 82*a*, in particular in a direction at least substantially parallel to the opening direction 100*a* of the receiving opening 96*a*.

The fixing unit 88*a* is embodied as a one-piece unit. The fixing unit 88*a* has a fixing element 92*a*. The fixing element 92*a* is configured for detachably fixing the insert 82*a* to the inner liner 10*a*. The fixing element 92*a* is at least substantially hook-shaped. The fixing element 92*a* comprises a head portion. The head portion is angled to a main extension direction of the fixing element 92*a*. The angle between the head portion and the main extension direction of the fixing element 92*a* is at least 270°. While fixing the insert 82*a* to the inner liner 10*a*, the fixing element passes through the pass-through opening 98*a*.

The fixing unit 88*a* comprises a bearing element 106*a*. The bearing element 106*a* is connected to an assembly element 104*a* of the insert 82*a*, in particular via the snap member 178*a*. The bearing element 106*a* is configured for pivoting the fixing element 92*a* about a pivot axis 108*a*. The pivot axis 108*a* is in particular at least substantially parallel to the opening direction 100*a* of the receiving opening 96*a*. Advantageously, the pivot axis 108*a* is a symmetry axis of the assembly element 104*a*, in particular of the pin 176*a* and/or of the bearing element 106*a*. The pin 176*a* and the bearing element 106*a* form in particular a bearing unit. The fixing unit 88*a* comprises an elastic element 110*a*. The elastic element 110*a* is configured for counteracting a rotation of the fixing element 92*a* about the pivot axis 108*a*. The elastic element 110*a* is embodied as a bow-spring.

The fixing unit 88*a* is at least mostly arranged inside the accommodation recess 84*a*. When the insert 82*a* is pushed into the storage space 12*a* in a push-in direction 94*a* of the insert 82*a*, the fixing element 92*a* is configured for fixing the insert 82*a* to the inner liner 10*a*. In addition, in a fixed position of the insert 82*a* the fixing element 92*a* blocks any movement of the insert 82*a* at least in the push-in direction 94*a* and/or in an opposite direction, in particular a pull-out direction. The home appliance device comprises two separate fixing units 88*a* arranged inside the opposite accommodation recesses 84*a*.

Figure 10:
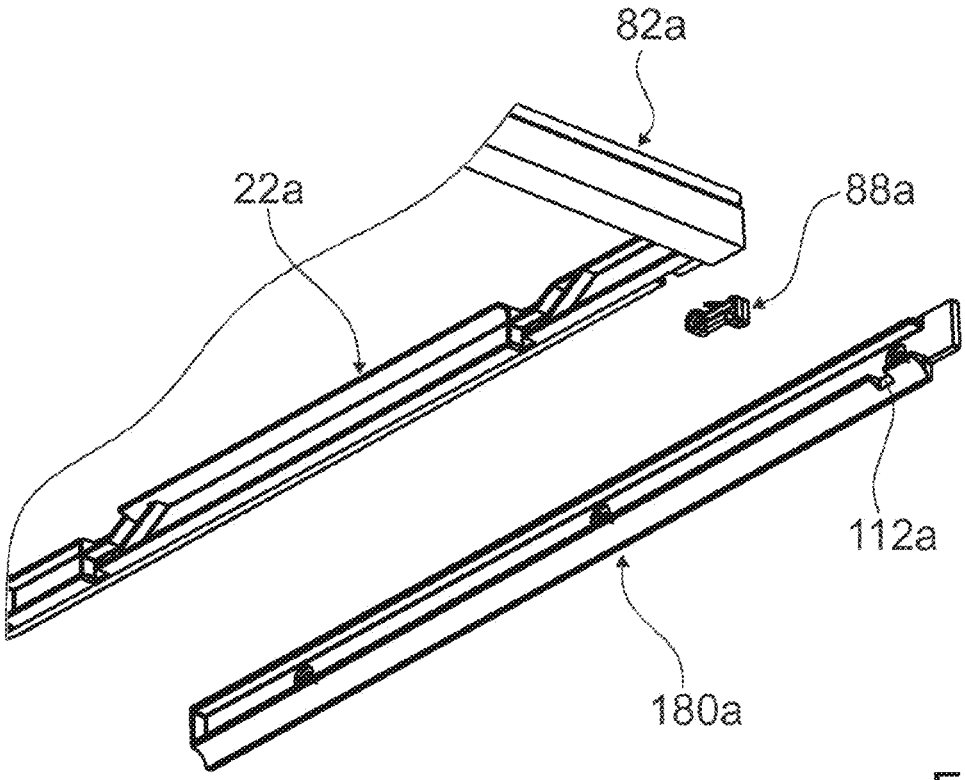
Figure 11:
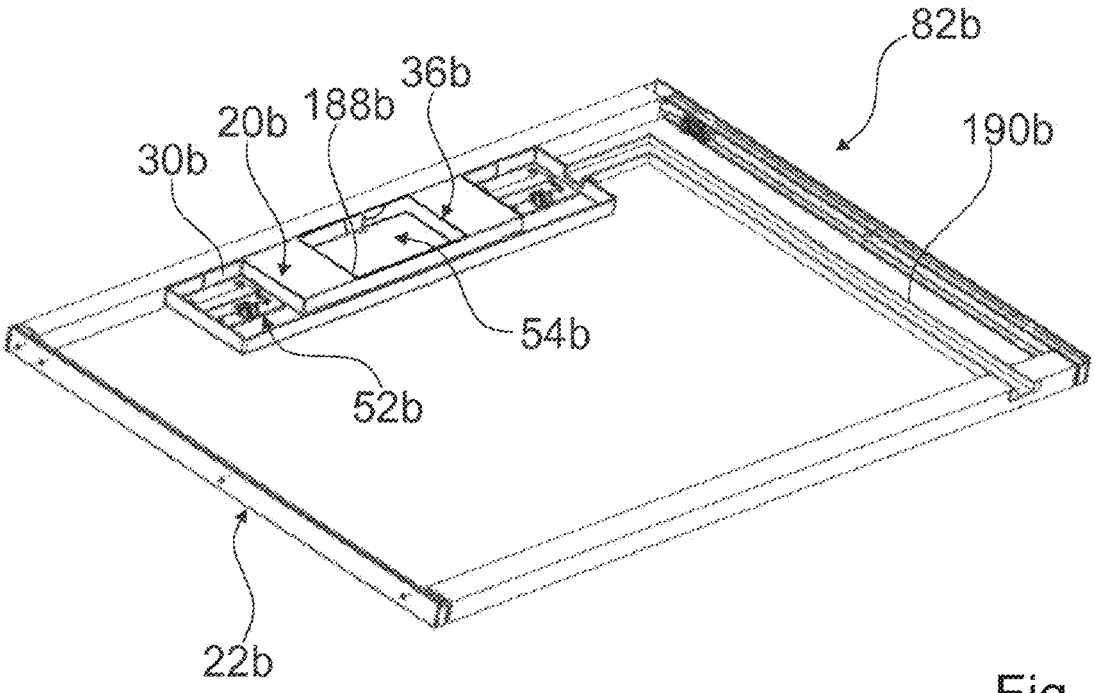
Figure 12:
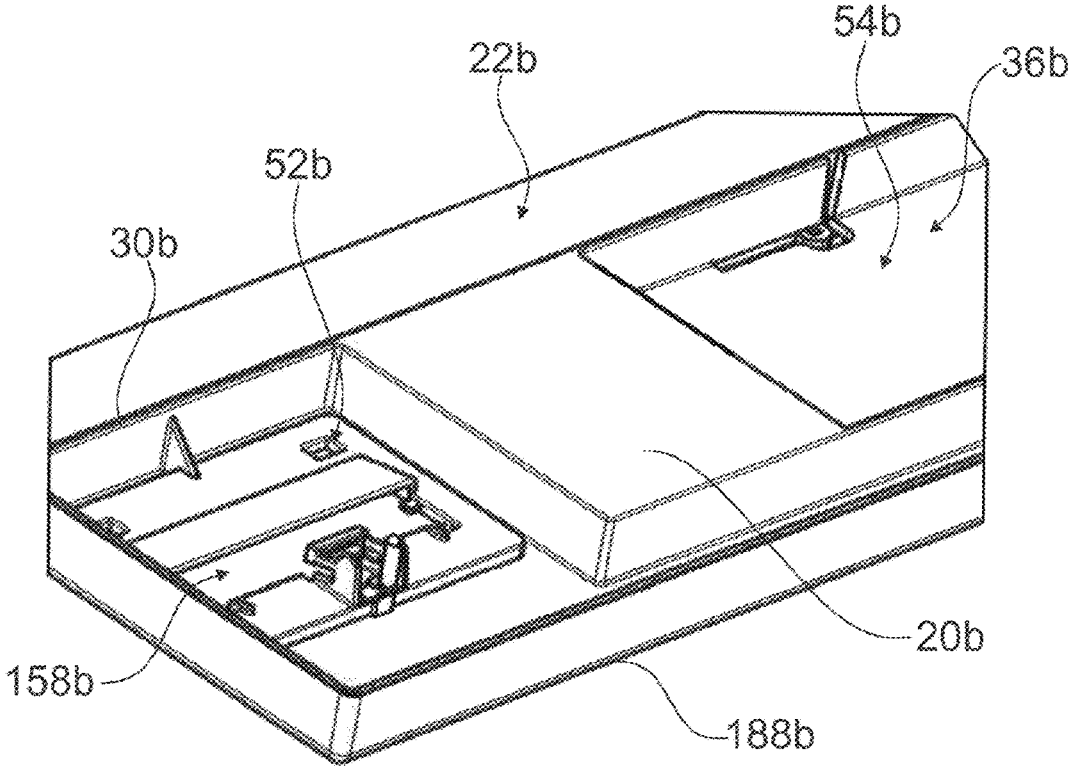
Figure 13:
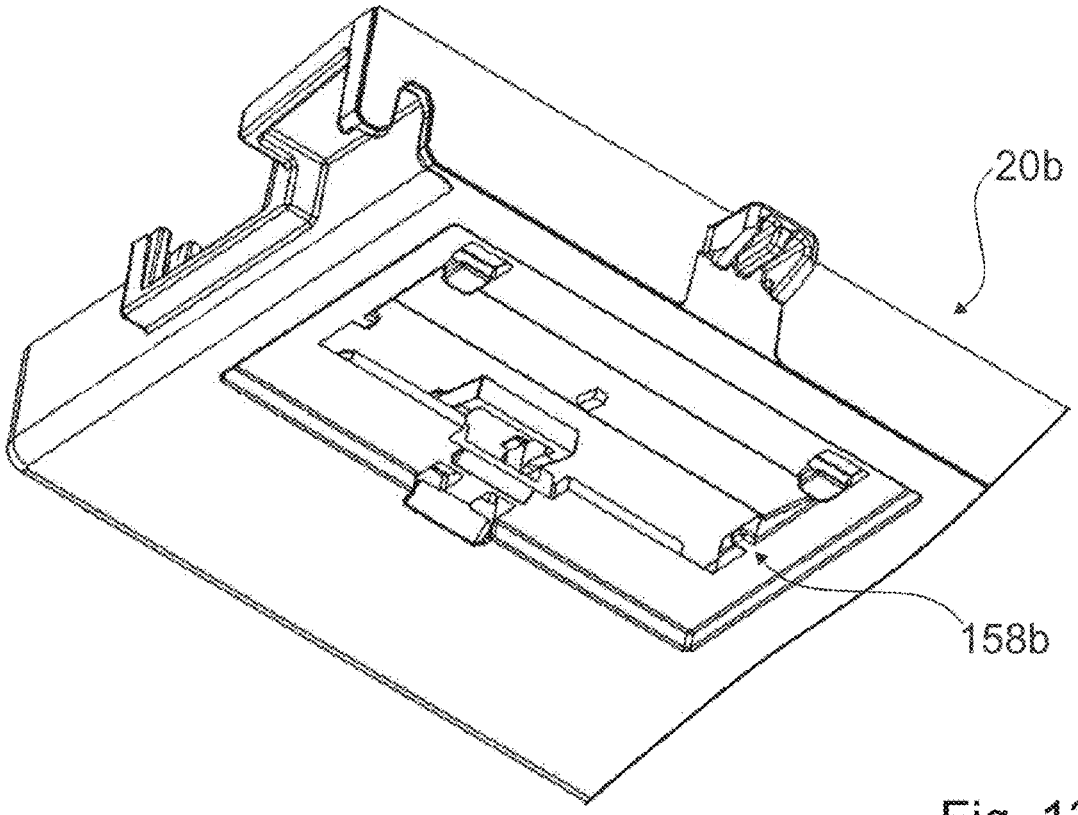
Figure 14:
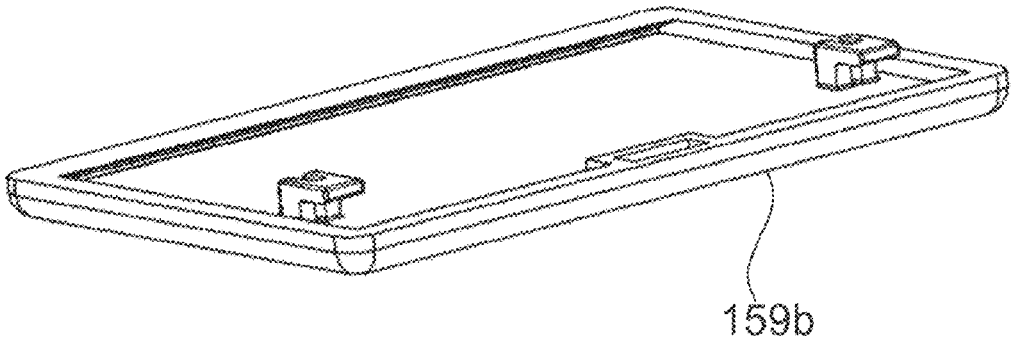

The home appliance device comprises a snap edge 112*a* (see FIG. 10). The snap edge 112*a* is coupled to the inner liner 10*a*. The snap edge 112*a* is configured for connecting with the fixing element 92*a*. In an assembly the fixing element 92*a* snaps into the snap edge 112*a*. The fixing element is fixed inside snap edge 112*a* by the elastic element 110*a*. For disassembly, the fixing element 92*a* can be deflected against the elastic element 110*a* by a user. The snap edge 112*a* is arranged on a side wall of the inner liner 10*a*. The home appliance device may comprise a directing element 180*a*. The directing element 180*a* is configured for directing the insert 82*a* in the push-in direction 94*a* when the insert 82*a* is inserted into the storage space 12*a*. The directing element 180*a* comprises the snap edge 112*a*. The directing element 112*a* is arranged at a side wall of the inner liner 10. The directing element 112*a* is embodied as a rail. The directing element 112*a* may preferably be integrally implemented with the inner liner 10*a*. The home appliance device comprises two directing elements 180*a* arranged on opposite sides of the inner liner 10*a*.

In FIGS. 11 to 32 further exemplary embodiments of the invention are shown. The following description is substantially limited to the differences between the exemplary embodiments, wherein regarding structural elements, features and functions that remain the same the description of the other exemplary embodiments, in particular the exemplary embodiment of FIGS. 1 to 10, may be referred to. For distinguishing the exemplary embodiments, the letter a of the reference numerals in the exemplary embodiment of FIGS. 1 to 10 has been substituted by the letters b to g in the reference numerals of the exemplary embodiments of FIGS. 11 to 32. Regarding structural elements having the same denomination, in particular regarding structural elements having the same reference numerals, principally the drawing and/or the description of the other exemplary embodiments, in particular of the exemplary embodiment of FIGS. 1 to 10, may be referred to.

FIGS. 11 to 14 show a further embodiment of a home appliance device. In this embodiment a receptacle 20*b* is configured for accommodating an illumination unit and a manual actuator. The receptacle 20*b* comprises at least two compartments 52*b*, 54*b*, namely a first compartment 52*b* and a second compartment 54*b*. The first compartment 52*b* is configured for at least partly accommodating the illumination unit. The second compartment 54*b* is configured for at least partly accommodating the manual actuator. The first compartment 52*b* at least partly encompasses the second compartment 54*b*. In this embodiment an upper side of the receptacle 20*b* is entirely open. The receptacle 20*b* is tray-shaped. The receptacle 20*b* comprises a base plate 188*b*. The receptacle 20*b* comprises an outer wall 30*b*. The outer wall 30*b* is arranged on the base plate 188*b*. A height of the outer wall 30*b* is at least substantially greater than a thickness of the base plate 188*b*.

Further, the home appliance device comprises a guiding tunnel 190*b*. The guiding tunnel 190*b* is configured for connecting the illumination unit to a control unit of the home appliance device. Inside the guiding tunnel 190*b* cables for connecting the illumination unit can be arranged. The guiding tunnel 190*b* keeps the cabling safe from external influences, such as moisture.

The receptacle 20*b* comprises an illumination opening 158*b*. The receptacle 20*b* comprises an illumination cover 159*b*. In this case the illumination cover 159*b* comprises two fixing elements. The receptacle 20*b* further comprises further fixing elements. The further fixing elements are at least partly shaped corresponding to the fixing elements of the illumination cover 159*b*. The illumination cover 159*b* is fixed to the base plate 188*b* of the receptacle 20*b* by the fixing elements and the further fixing elements.

Figure 15:
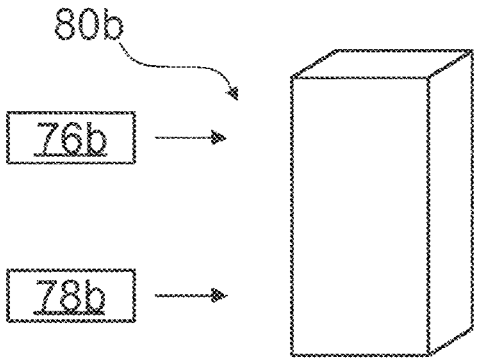

In FIG. 15 a construction kit 80*b* for a home appliance device is shown in a schematic view. The construction kit 80*b* is configured for constructing the home appliance device. The construction kit 80*b* comprises a frame 22*b*. The construction kit 80*b* comprises a first module 76*b*. The construction kit 80*b* further comprises a second module 78*b*. The first module 76*b* comprises the manual actuator. Further, the first module 76*b* comprises the receptacle 20*b*. The receptacle 20*b* at least partly accommodates the manual actuator. The receptacle 20*b* is fixable to the frame 22*b*. Preferably the receptacle 20*b* accommodates only the manual actuator. The first module 76*b* is advantageously free of any illumination unit configured for illuminating an interior of a container.

The second module 78*b* comprises a further manual actuator. Further, the second module 78*b* comprises an illumination unit. The second module 78*b* comprises a receptacle 20*b*. The receptacle 20*b* at least partly accommodates the illumination unit and at least partly the manual actuator. The receptacle 20*b* is fixable to the frame 22*b*.

Figure 16:
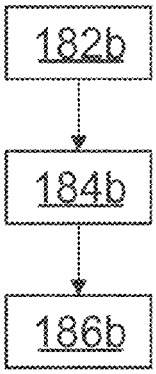

In FIG. 16 a method for constructing the home appliance device is shown in a schematic view. In a method step 182*b* the frame 22*b* is provided. In a further method step 184*b* the first module 76*b* and/or the second module 78*b* are provided. In a further method step 186*b* either the first module 76*b* or the second module 78*b* is fixed to the frame 22*b*. Alternatively or additionally both modules 76*b*, 78*b* or a plurality of first and second modules 76*b*, 78*b* and frames 22*b* can be provided for manufacturing the home appliance device. As a result, different home appliances of different qualities and values can be easily constructed with the same construction kit 80*b*. Furthermore, a number of required parts can be reduced.

Figure 17:
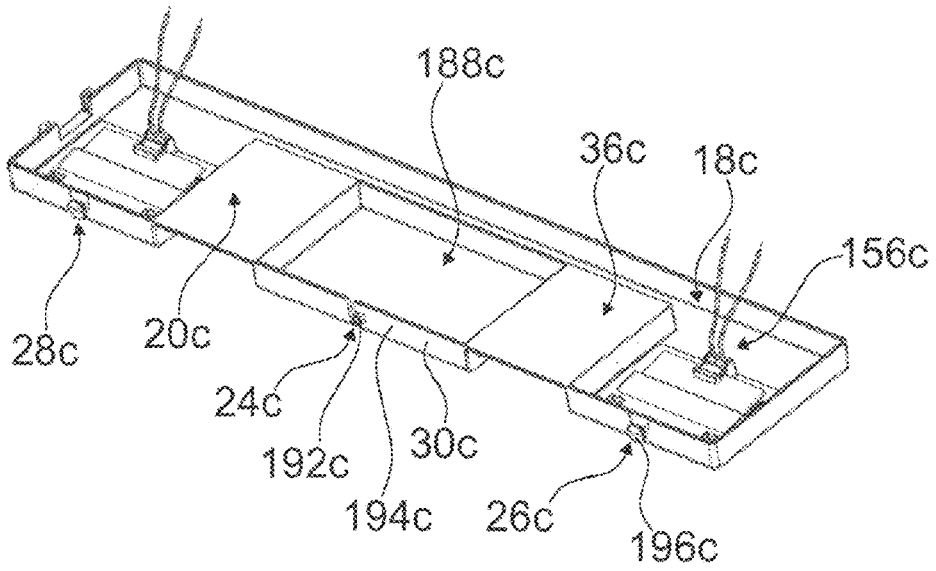
Figure 18:
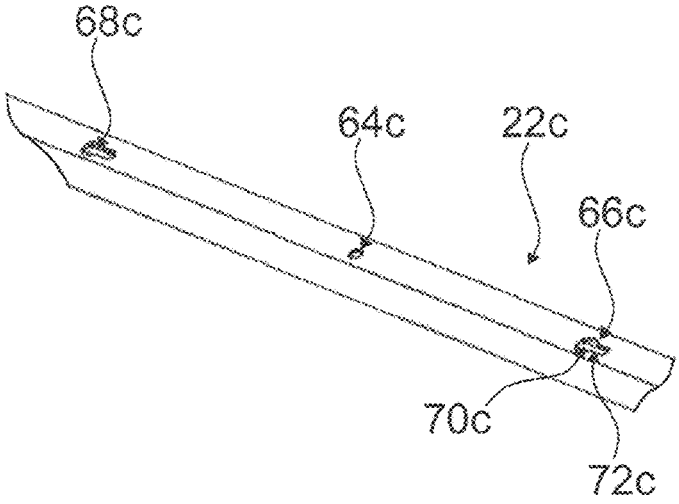
Figure 19:
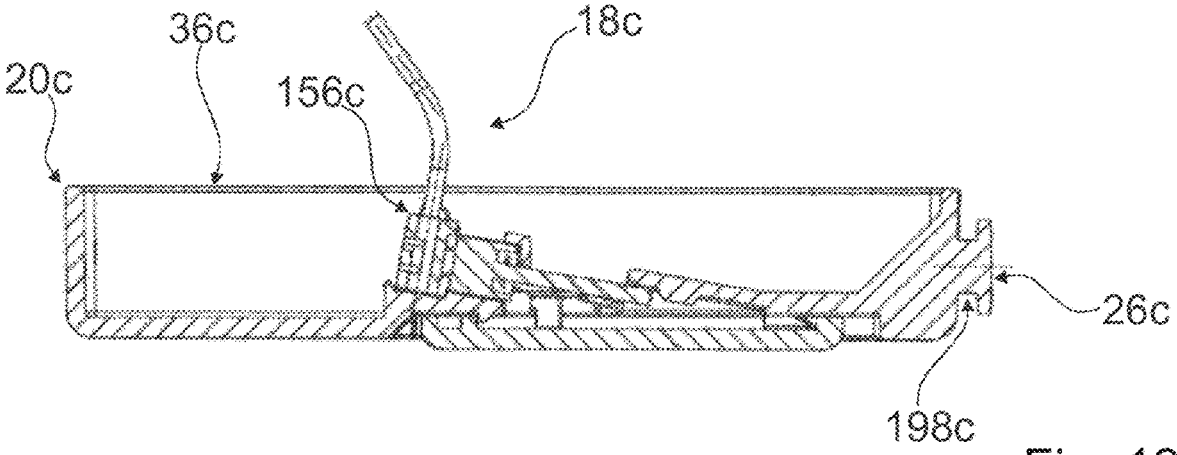
Figure 20:
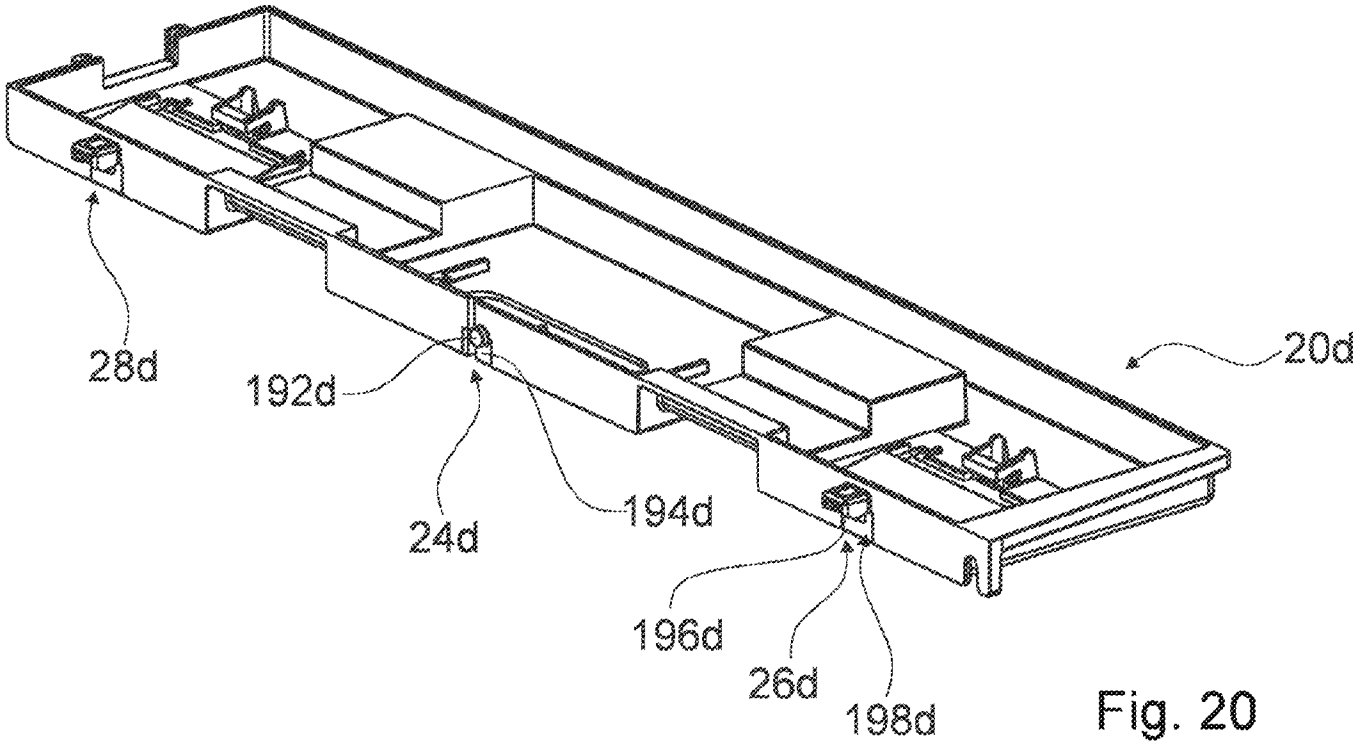
Figure 21:
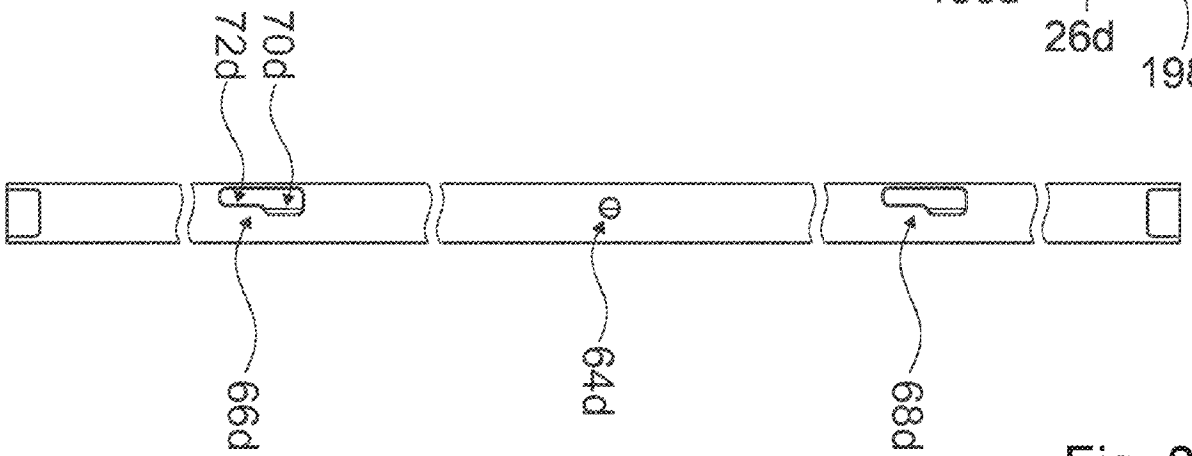

FIGS. 17 to 19 show a further embodiment of the home appliance device comprising a receptacle 20*c* and a frame 22*c* in different views. The receptacle 20*c* comprises a latching element 24*c*. The latching element 24*c* is configured for fixing the receptacle 20*c* to the frame 22*c*. The latching element 24*c* is deformable. The latching element 24*c* is at least partly deformable in a direction at least substantially perpendicular to the main extension direction of the receptacle 20*c* and/or the frame 22*c*. Viewed in an installed state of the home appliance device, the latching element 24*c* is arranged at a front side of the receptacle 20*c*. An outer wall 30*c* of the receptacle 20*c* at least partly integrally implements the latching element 24*c*. The latching element 24*c* comprises a latching hook 192*c*. The latching element 24*c* comprises a deformable latching arm 194*c*. The latching arm 194*c* is connected to the latching hook 192*c*. In a vicinity of the latching element 24*c* the outer wall 30*c* is embodied at least partly separate from a base plate 188*c* of the receptacle 20*c*.

The receptacle 20*c* comprises a holding element 26*c*. The receptacle 20*c* comprises a further holding element 28*c*. The holding element 26*c* and the further holding element 28*c* are at least substantially identical to each other. In the following the holding element 26*c* is described in detail. The description of the holding element 26*c* may be correspondingly transferred to the further holding element 28*c*. The holding element 26*c* is configured for fixing the receptacle 20*c* to the frame 22*c*. Viewed in an installation position, the holding element 26*c* is arranged at a front side of the receptacle 20*c*. The holding element 26*c* has a higher degree of rigidity than the latching element 24*c*. Furthermore, the holding element 26*c* may be at least partly embodied by the outer wall 30*c*. The holding element 26*c* comprises an insert element 196*c*. The insert element 196*c* is circular-shaped. The holding element 26*c* comprises a notch 198*c*.

The frame 22*c* comprises a securing recess 64*c* (see FIG. 18). The securing recess 64*c* is shaped at least partly corresponding to the latching element 24*c*. The frame 22*c* further comprises a holding recess 66*c*. The holding recess 66*c* is shaped at least partly corresponding to the holding element 26*c*. The frame 22*c* further comprises a further holding recess 66*c*. The further holding recess 66*c* is shaped at least partly corresponding to the further holding element 28*c*. The holding recess 66*c* and the further holding recess 68*c* are at least substantially identical. In the following description the holding recess 66*c* is described in detail. The description of the holding recess 66*c* may be correspondingly transferred to the further holding recess 68*c*. The holding recess 68*b* is at least substantially circular-shaped. The holding recess 66*c* has an insert portion 70*c*. The insert portion 70*c* is configured for receiving the holding element 26*c*, in particular the insert element 196*c* of the holding element 26*c*. The insert portion 70*c* is at least partly circular shaped. The holding recess 66*c* has a holding portion 72*c*. The holding portion 72*c* is at least partly circular shaped. The insert portion 70*c* and the holding portion 72*c* are connected, in particular forming a single opening. The holding recess 66*c* is configured for fixing the holding element 26*c*, in particular the notch 198*c*, in a form-fit manner, preferably inside the holding portion 72*c*.

In one assembly step the holding recess 66*c* receives the holding element 26*c* when the frame 22*c* and the receptacle 20*c* are moved towards each other, preferably at least substantially perpendicular to each other. In a further assembly step the securing recess 64*c* catches the latching element 24*c* when the frame 22*c* and the receptacle 20*c* are moved alongside each other, preferably at least substantially parallel to each other. In an assembled state the securing recess 64*c* is configured for locking the latching hook 192*c* of the latching element 24*c* in place.

In a disassembly step the securing recess 64*c* releases the latching element 24*c* when the latching element 24*c* is pushed towards the receptacle 20*c*. In a further disassembly step, the holding recess 66*c* releases the holding element 26*c* when the frame 22*c* and the receptacle 20*c* are moved alongside each other, preferably at least substantially parallel to each other.

FIGS. 20 to 27 show a further embodiment of the home appliance device comprising a receptacle 20*d* and a frame 22*d* in different views. In this case a holding element 26*d* of the receptacle 20*d* is at least substantially wedge-shaped. A holding recess 66*d* of the frame 22*d* is at least substantially L-shaped. The holding recess 66*d* comprises an insert portion 70*d*. The insert portion 70*d* is at least substantially shaped rectangularly. Further the holding recess 66*d* comprises a holding portion 72*d*. The holding portion 72*d* is at least substantially shaped rectangularly.

Figure 22:
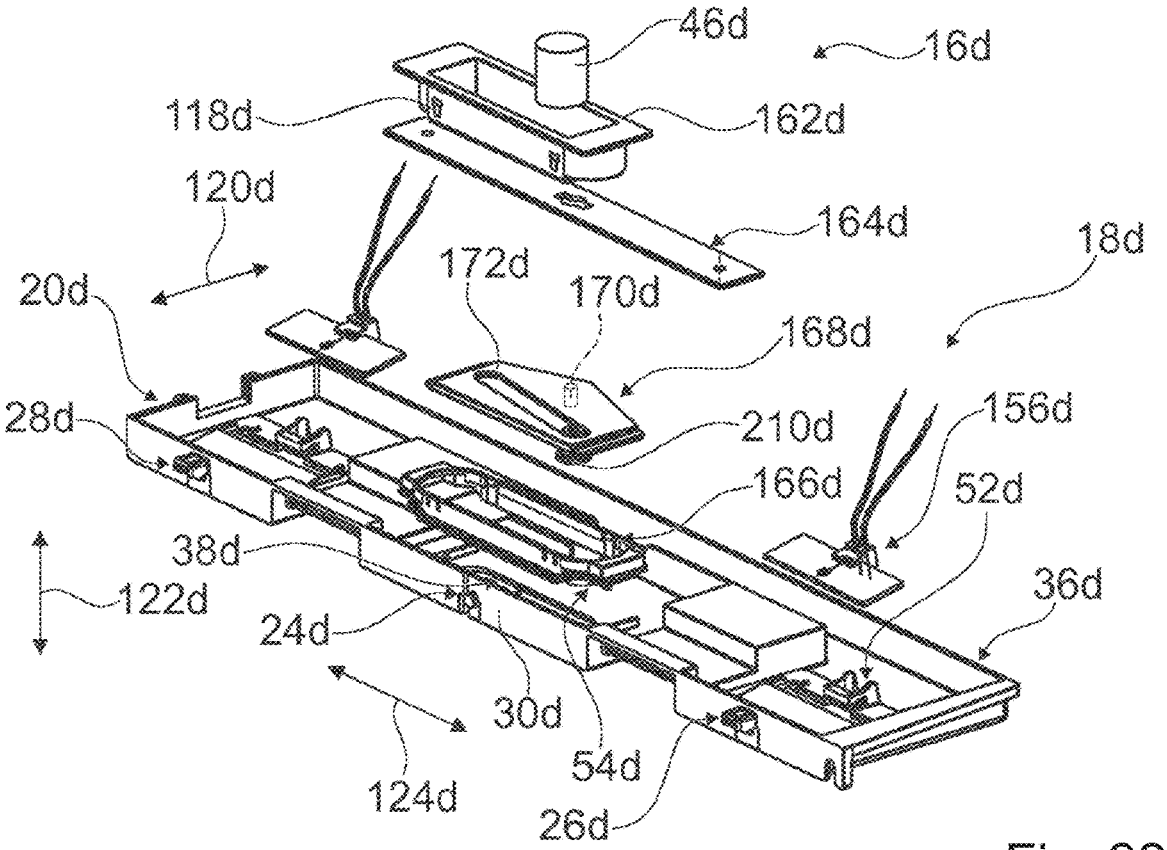

FIG. 22 shows an exploded view of the receptacle 20*d*, the manual actuator 16*d* and the illumination unit 18*d*. The illumination unit 18*d* is accommodated inside a first compartment 52*d* of the receptacle 20*d*. The manual actuator 16*d* is at least partly accommodated inside a second compartment 54*d* of the receptacle 20*d*.

Figure 23:
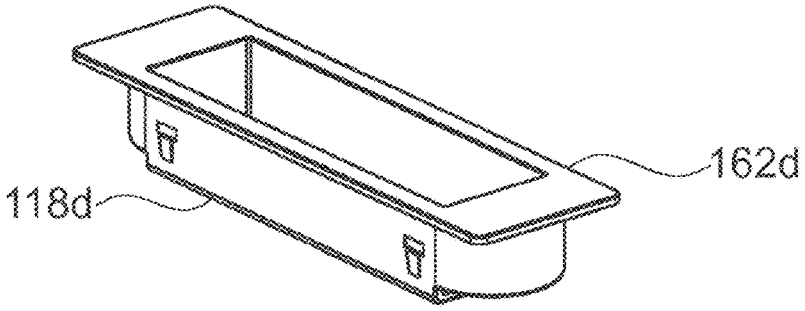

The manual actuator 16*d* comprises a subhousing 162*d* (see FIG. 23). In an installed state a control element 46*d* of the manual actuator 16*d* is movably accommodated inside the subhousing 162*d*. A closing plate 42*d* of the home appliance device comprises a receiving recess 44*d* (see FIG. 25). The subhousing 162*d* may be fixed to the closing plate 42*d* in positive manner. The receiving recess 44*d* receives the subhousing 162*d* in particular together with the control element 46*d* in an installed position. The control element 46*d* is at least substantially flush with a top surface of the closing plate 42*d*. A guiding element 118*d* is connected to the subhousing 162*d*.

The manual actuator 16*d* comprises the guiding element 118*d*. The control element 46*d* is arranged movably in the guiding element 118*d*. The control element 46*d* comprises a bolt 208*d*. The bolt 208*d* engages into the guiding element 118*d*. The control element 46*d* can be made of plastic, metal and/or metal-coated plastic. The guiding element 118*d* guides a movement of the control element 46*d*. The guiding element 118*d* prevents two spatial degrees of freedom of the control element 46*d*. In particular the guiding element 118*d* limits all but one spatial degree of freedom. The guiding element 118*d* prevents a movement of the control element in two directions 120*d*, 122*d*, namely a first direction 120*d* and a second direction 122*d*. The first direction 120*d* is at least substantially parallel to a horizontal plane of the home appliance device in an installation position. The second direction 122*d* is at least substantially perpendicular to a horizontal plane of the home appliance device in an installation position. The guiding element 118*d* allows a movement of the control element 46*d* in a third direction 124*d*. The third direction 124*d* is at least substantially parallel to a horizontal plane of the home appliance device in an installation position. Furthermore, the third direction 124*d* is at least substantially perpendicular to the first direction 120*d* and/or the second direction 122*d*. Further, the guiding element 118*d* limits a movement of the control element 46*d* in a movement direction, in particular at least substantially parallel to the third direction 124*d*, to a certain length. The guiding element 118*d* comprises two ends, which function as stops for the control element 46*d*. The guiding element 118*d* is embodied as a rail. Further, the guiding element 118*d* is fixed to the subhousing 162*d*, in particular in a positive or non-positive manner. Alternatively or additionally the subhousing 162*d* and the guiding element 118*d* may be integrally implemented.

The manual actuator 16*d* further comprises an indicator element 164*d*. The indicator element 164*d* is movably arranged between the control element 46*d* and the guiding element 118*d*. The indicator element 164*d* is connected to the control element 46*d*. The bolt 208*d* of the control element 46*d* engages into the indicator element 164*d*. The indicator element 164*d* is configured to display a position of the control element 46*d* with respect to the guiding element 118*d* and in particular to display a humidity in a container corresponding to the position of the control element 46*d*. The indicator element 164*d* comprises at least two indicators for at least two positions of the control element 46*d*. In this case the two positions correspond to the control element 46*d* being stopped at each end of the guiding element 118*d*. The indicator element 164*d* can be made of plastic, metal and/or plastic-coated metal. The indicators can in particular be embodied as a print, as a separate element fixed with glue and/or as a stamping in particular on a sheet or on an extruded metal.

The manual actuator 16*d* comprises a direction transformation unit 168*d*. The direction transformation unit 168*d* is configured for at least partly transforming a movement of the control element 46*d* parallel to the horizontal plane, in particular in the third direction 124*d*, into a movement in another direction parallel to the horizontal plane, in particular at least substantially perpendicular to the previous movement of the control element 46*d*, preferably into the first direction 120*d*. The direction transformation unit 168*d* comprises a transformation guiding element 172*d*. The control element 46*d* is movably coupled to the transformation guiding element 172*d*. The bolt 208*d* engages into the transformation guiding element 172*d*. The transformation guiding element 172*d* is angled with respect to the guiding element 118*d*. The angle formed by the guiding element 118*d* and the transformation guiding element 172*d* is between 0° and 90°. The manual actuator 16*d* comprises a link 170*d* configured for coupling the direction transformation unit 168*d* to a cover 148*d* configured for closing an opening of the container. The link 170*d* is connected to the direction transformation unit 168*d*. The link 170*d* is integrally implemented with the direction transformation unit 168*d*. The direction transformation unit 168*d* transmits a movement of the control element 46*d* to the cover 148*d*. By the movement of the control element 46*d*, in particular in the third direction 124*d*, the cover 148*d* is moved in another direction, in particular at least in the first direction 124*d*. The transformation guiding element 172*a* is embodied as a rail.

The manual actuator 16*d* comprises an adapter connector 166*d*. The adapter connector 166*d* connects further units of the manual actuator 16*d*, in particular the control element 46*d*, the subhousing 162*d*, the indicator element 164*d*, the guiding element 118*d* and/or the direction transformation unit 168*d* to the receptacle 20*d*.

In the following description an exemplary assembly of the manual actuator 16*d* is described. In assembly, the guiding element 118*d* is connected to the subhousing 162*d*. The subhousing 162*d* is inserted into the receiving recess 44*d* of the closing plate 42*d*, in particular together with the guiding element 118*d*. The adapter connector 166*d* is at least partly put over the subhousing 162*d* and in particular the guiding element 118*d*. The indicator element 164*d* is slid into the adapter connector 166*d*. In particular, the indicator element 164*d* is slid between the guiding element 118*d* and the subhousing 162*d*. The direction transformation unit 168*d*, in particular the transformation guiding element 172*d* is arranged below the adapter connector 166*d* and preferably on top of the base plate 188*a* of the receptacle 20*d*. The control element 46*d* is inserted into the subhousing 162*d*. The bolt 208*d* of the control element 46*d* engages into the indicator element 164*d*, the guiding element 118*d* and the transformation guiding element 172*d*. The receptacle 20*d* comprises a pass-through recess 38*d*. In assembly, a connection joint 210*d* of the manual actuator 16*d* engages into the pass-through recess 38*d* and in particular into the transformation guiding element 172*d* of the direction transformation unit 168*d*. The connection joint 210*d* connects with the bolt 208*d* of the control element 46*d*. In this case the bolt 208*d* and the connection joint 210*d* may form a screw connection and/or a rivet connection. Alternatively or additionally the connection joint 210*d* and the bolt 208*d* may be glued together. In an installed state, the manual actuator 16*d* is fixed to the closing plate 42*d* and the receptacle 20*d* in particular by the connection between the bolt 208*d* and the connection joint 210*d*. The link 170*d* of the direction transformation unit 168*d* passes through a further passthrough recess 39*d* of the receptacle 20*d*. The link 170*d* engages with the cover 148*d*. The manual actuator 16*d* comprises a further connection joint 212*d*. The further connection joint 212*d* connects the link 170*d* to the cover 148*d*.

In an operating state of the home appliance device the control element 46*d* can be slid alongside the guiding element 118*d*, in particular in a third direction 124*d*. By the movement of the control element 46*d* the bolt 208*d* is moved. The bolt 208*d* runs inside the transformation guiding element 172*d* of the direction transformation unit 168*d*. The transformation guiding element 172*d* gets deflected by the bolt 208*d*. As a result the direction transformation unit 168*d* is moved in a direction at least substantially perpendicular to the movement direction, in particular in the first direction 120*d*, of the control element 46*d*. The link 170*d* couples the movement of the direction transformation unit 168*d* to the cover 148*d*.

A guiding unit 174*d* of the frame 22*d* comprises a profile 200*d*. The profile 200*d* has an inclination with respect to the frame 22*d*. Thus, the guiding unit 174*d* is configured to transform a movement of the cover 148*d* in the first direction 120*d*, in particular at least substantially parallel to a horizontal plane of the home appliance device in an installation position, at least partly into a movement of the cover 148*d* in a second direction 122*d*, in particular at least substantially perpendicular to a horizontal plane of the home appliance device in an installation position. By the interplay of the manual actuator 16*d* and the guiding unit 174*d* a movement of the control element 46*d* in the third direction 124*d* is transformed into a movement of the cover 148*d* in the second direction 122*d*. A movement of the control element 46*d*, in particular in the third direction 124*d*, is transformed by the direction transformation unit 168*d* into a movement of the cover 148*d*, in particular in the first direction 120*d*. The guiding unit 174*d* transforms the movement of the cover 148*d*, in particular in the first direction 120*d*, at least substantially perpendicular, namely in particular into a movement in the second direction 122*d*.

Figure 24:
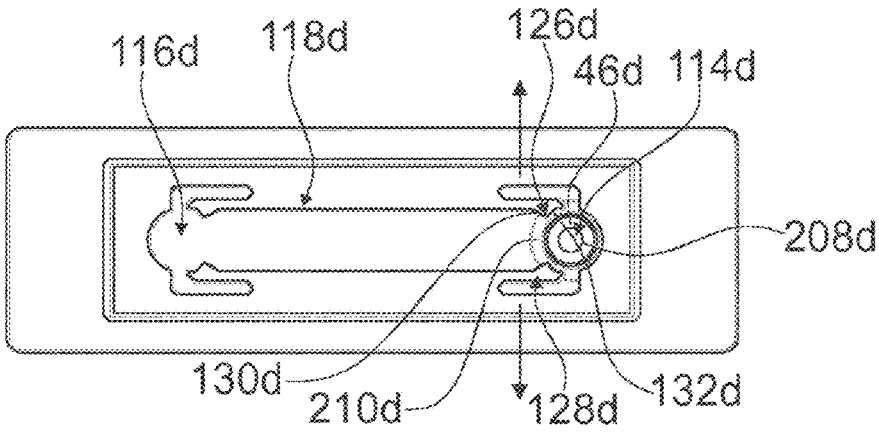
Figure 25:
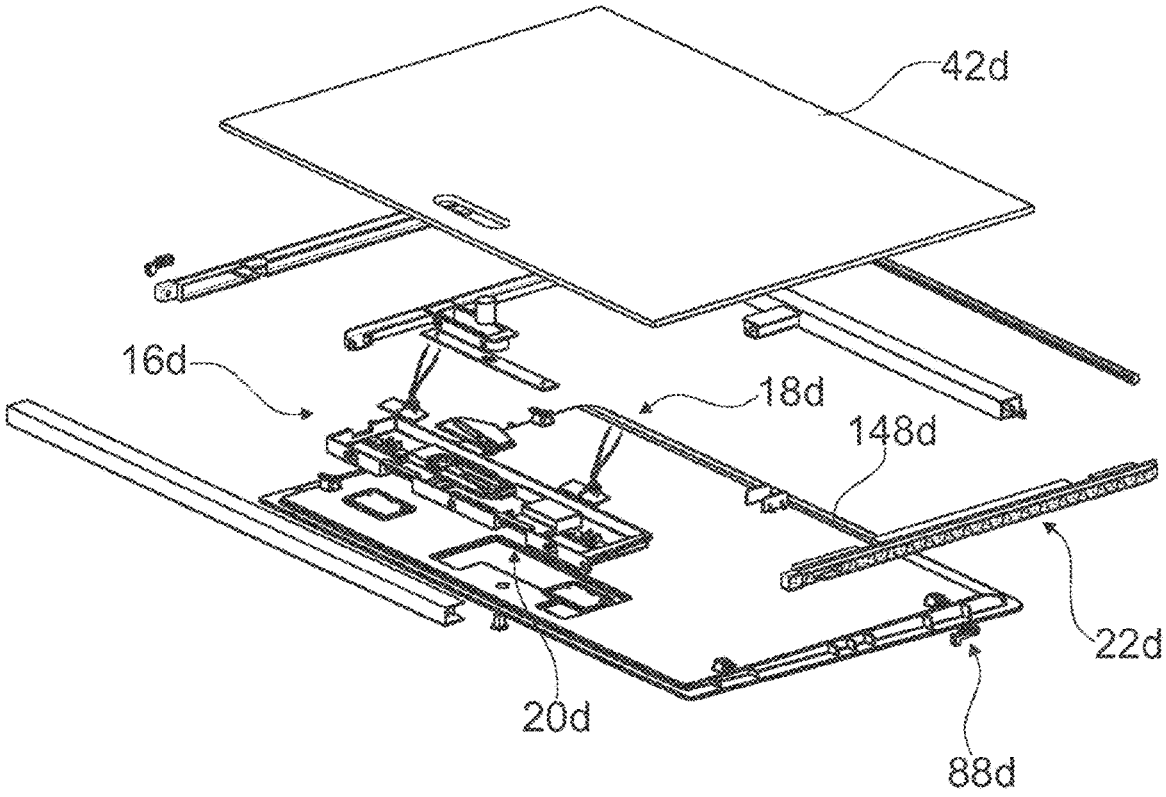
Figure 26:
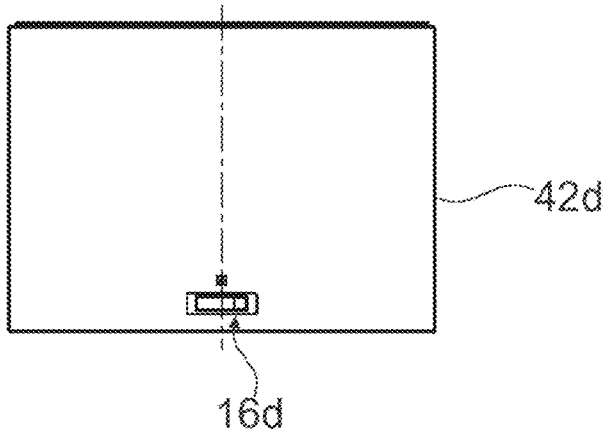
Figure 27A:
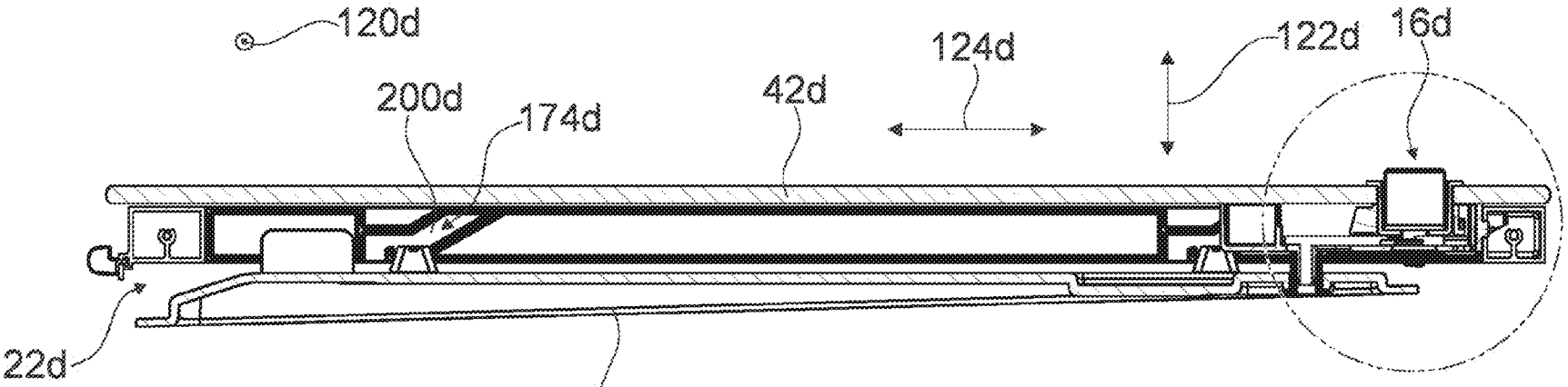
Figure 27B:
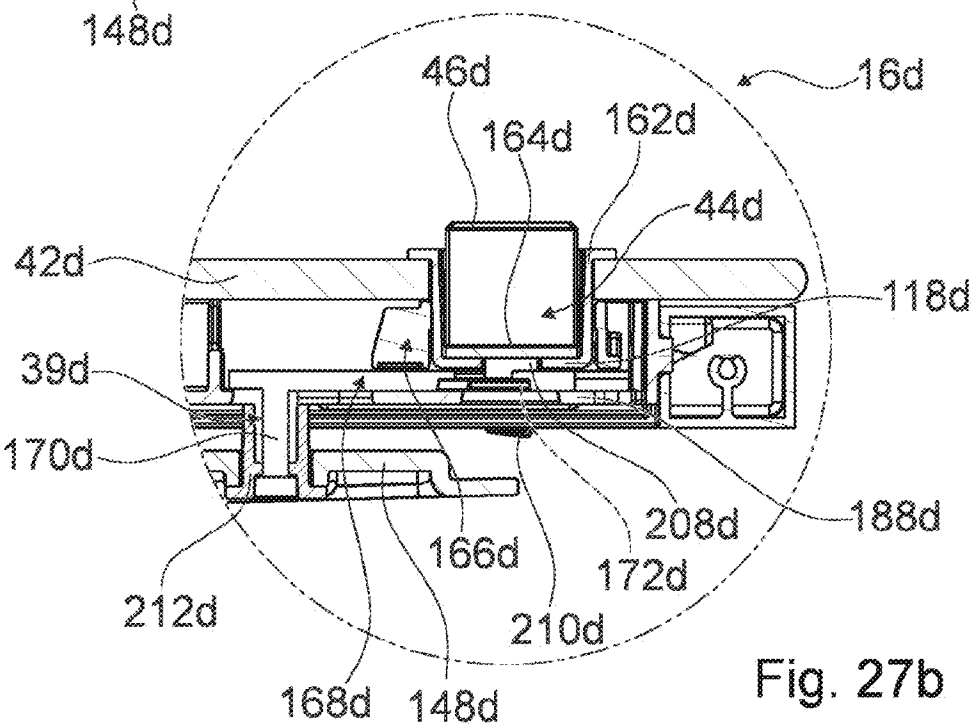

The manual actuator 16*d* defines at least one lock-in position 114*d* for the control element 46*d* (see FIG. 24). The lock-in position 114*d* in particular corresponds to a preferably factory-set default level of humidity inside the container. The control element 46*d* is configured to be nondestructively released from the lock-in position 114*d* when a force acting on the control element 46*d* exceeds a holding force that holds the control element 46*d* in the lock-in position 114*d*. The manual actuator 16*d* comprises at least one snap element 126*d* configured for locking the control element 46*d* in the lock-in position 114*d*. The snap element 126*d* is in particular deformable in a direction at least substantially parallel to the horizontal plane of the home appliance device in an installation position. The snap element 126*d* is deformable. The snap element 126*d* is deformable in a direction at least substantially perpendicular to a movement direction of the control element 46*d*. The manual actuator 16*d* comprises at least one further snap element 128*d*. The further snap element 128*d* is located opposite the snap element 126*d*. The further snap element 128*d* is deformable in a direction counter to a direction in which the snap element 126*d* is deformable. The further snap element 128*d* is mirror-inverted to the snap element 126*d*. The further snap element 128*d* is embodied at least substantially identical to the snap element 126*d*. For better clarity, in the following only one snap element 126*d* is described in detail. The following description can correspondingly be transferred to the further snap element 128*d*.

The snap element 126*d* comprises two guiding chamfers 130*d*, 132*d*, namely a first guiding chamfer 130*d* and a second guiding chamfer 132*d*. The first guiding chamfer 130*d* is configured for contacting the control element 46*d*. The first guiding chamfer 130*d* is configured for deforming the snap element 126*d* in case of a movement of the control element 46*d* in a first movement direction and when the control element 46*d* applies a force to the first guiding chamfer 130*d*. The second guiding chamfer 132*d* is configured for contacting the control element 46*d*. The second guiding chamfer 132*d* is configured for deforming the snap element 126*d* in case of a movement of the control element 46*d* in a second movement direction, in particular opposite to the first movement direction, and when the control element 46*d* applies a force to the chamfer 132*d*. The guiding chamfers 130*d*, 132*d* respectively include an angle with the movement direction of the control element 46*d* between 0° and 90°, preferably between 0° and 75° and advantageously between 0° and 45°. The guiding element 118*d* of the manual actuator 16*d* and the snap elements 126*d*, 128*d* are integrally implemented.

The manual actuator 16*d* defines a further lock-in position 116*d* for the control element 46*d*. The further lock-in position 116*d* is implemented at least substantially identical to the lock-in position 114*d*, in particular as described above. The lock-in positions 114*d*, 116*d* correspond to the two different positions indicated by the indicator element 164*d*. The lock-in positions 114*d*, 116*d* respectively correspond to at least one humidity level inside the container. The lock-in position 114*d* corresponds to a maximum humidity level inside the container. The maximum humidity level in particular corresponds to a minimum opening degree of the opening of the container. In particular, the minimum opening degree is reached when the surface of the opening is at least mostly and advantageously entirely covered. The further lock-in position 116*d* corresponds to a maximum humidity level inside the container. The further lock-in position 116*d* corresponding to a minimum humidity level inside the container. The minimum humidity level in particular corresponds to a maximum opening degree of the opening of the container. Advantageously, the maximum opening degree is reached when the surface of the opening of the container is at least mostly and advantageously entirely uncovered.

Figure 28:
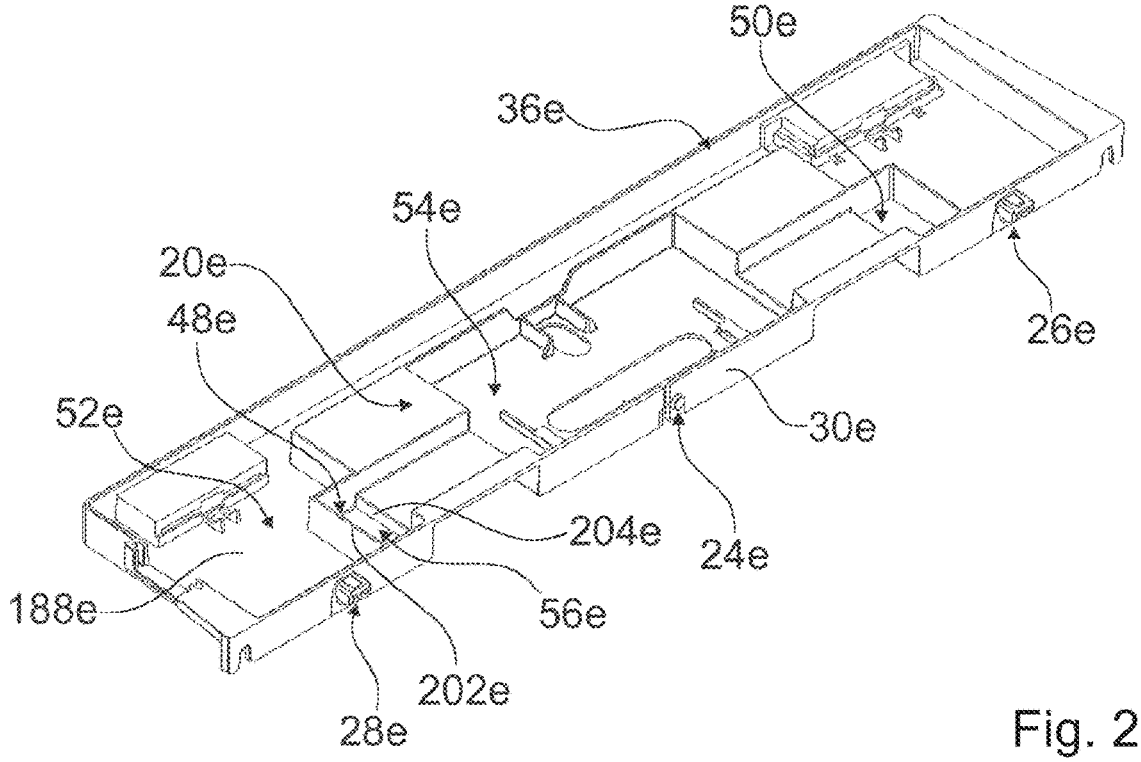
Figure 29:
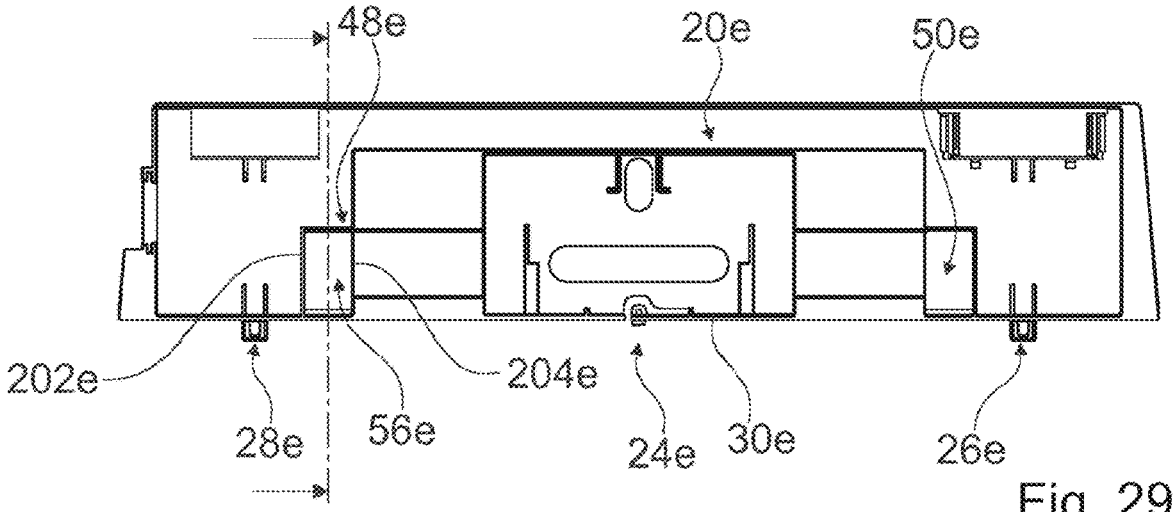
Figure 30:
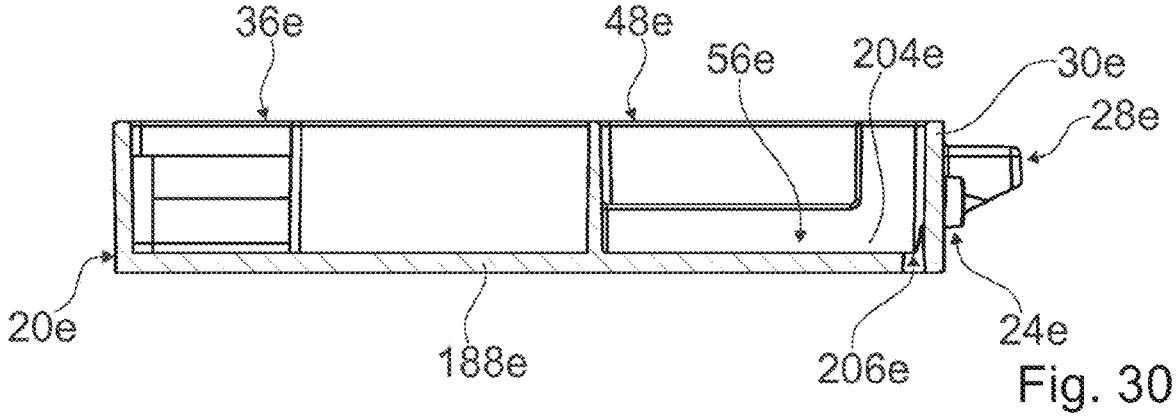

FIGS. 28, 29 and 30 show a further embodiment of a home appliance device. A receptacle 20*e* of the home appliance device comprises a protective inner barrier 48*e*. The protective inner barrier 48*e* is arranged inside the receptacle 20*e*. The protective inner barrier 48*e* is distinguishable from an outer wall 30*e*. The protective inner barrier 48*e* extends in particular at least partly from a base plate 188*e* of the receptacle 20*e* to a closing plate. The protective inner barrier 48*e* separates the receptacle 20*e* into two compartments 52*e*, 54*e*, namely a first compartment 52*e* and a second compartment 54*e*. The first compartment 52*e* is configured for at least partly accommodating an illumination unit. The second compartment 54*e* is configured for at least partly accommodating a manual actuator. Further, the receptacle 20*e* comprises a further protective inner barrier 50*e*. The protective inner barriers 48*e*, 50*e* are at least substantially identical. The protective inner barriers 48*e*, 50*e* are arranged mirror-inverted to each other inside the receptacle 20*e*. Viewed in a direction perpendicular to the main extension direction of the receptacle 20*e*, the protective inner barriers 48*e*, 50*e* are arranged on opposite sides. For better clarity, in the following the protective inner barrier 48*e* is described in detail. The following description can correspondingly be transferred to the further protective inner barrier 50*e*.

The inner barrier 48*e* comprises at least two side walls 202*e*, 204*e*, namely a first side wall 202*e* and a second sidewall 204*e*. The first side wall 202*e* delimits the first compartment 52*e*. The second sidewall 204*e* faces away from the second compartment 54*e*. Furthermore, the protective inner barrier 48*e* comprises a drainage channel 56*e*. The side walls 202*e*, 204*e* define at least partly the drainage channel 56*e*. The drainage channel 56*e* may comprise a slope configured for leading condensed water away from the illumination unit. The protective inner barrier 56*e* further comprises a drain 206*e*. The drain 206*e* is connected to the drainage channel 56*e*. The drain 206*e* is configured for transporting condensed water out of the receptacle 20*e*. The drain 206*e* is embodied as an opening in the receptacle 20*e*, in particular in a base plate 188*e* of the receptacle 20*e*.

Figure 31:
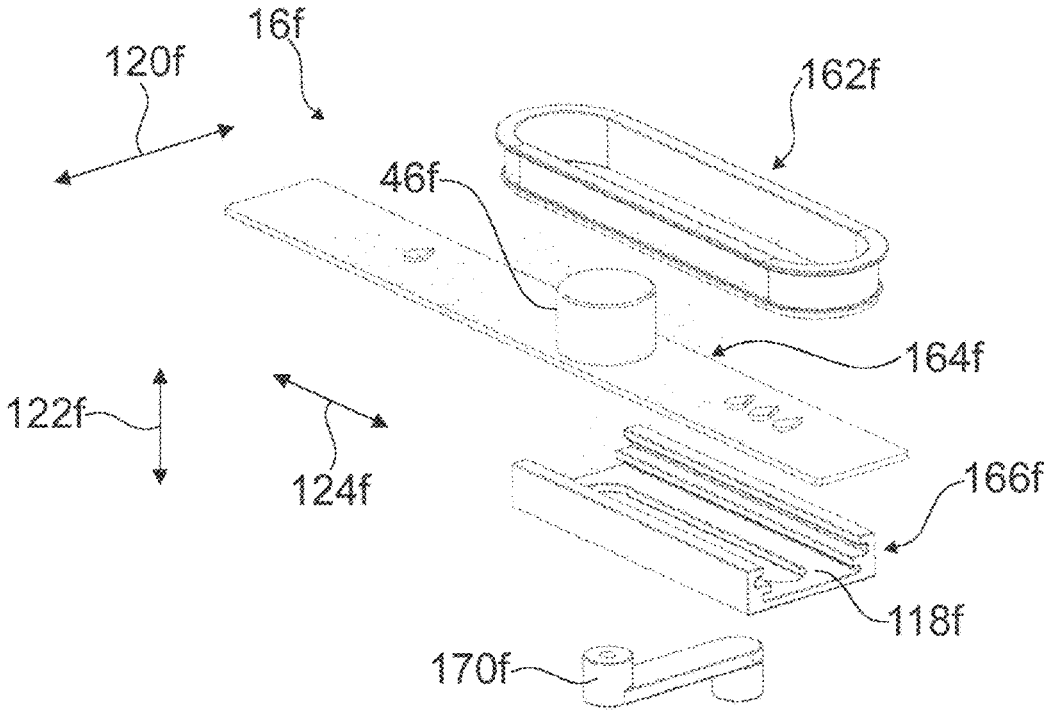
Figure 32:
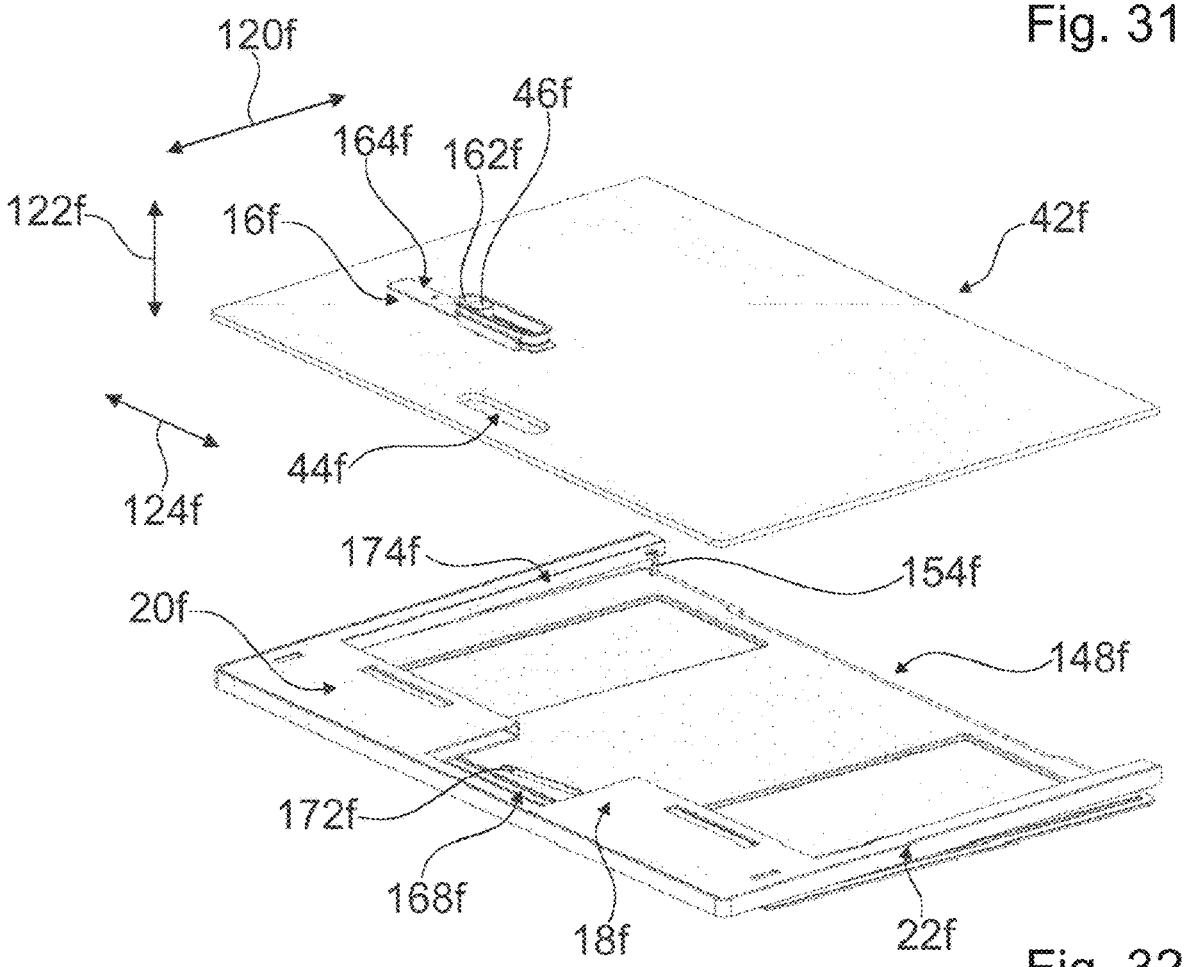

FIGS. 31 and 32 show another exemplary embodiment of a home appliance device. In this case a direction transformation unit 168*f* of a manual actuator 16*f* is at least partly integrally implemented with a cover 148*f* of the home appliance device. A transformation guiding element 172*f* of the direction transformation unit 168*f* is embodied as a recess of the cover 148*f*. Further, a guiding element 118*f* of the manual actuator 16*f* is integrally implemented with an adapter connector 166*f* of the manual actuator 16*f*. In assembly a subhousing 162*f* of the manual actuator 16*f* is slidable into the adapter connector 166*f*. Furthermore a link of the manual actuator 16*f* is implemented separate from the transformation guiding element 172*f*.

Figure 33:
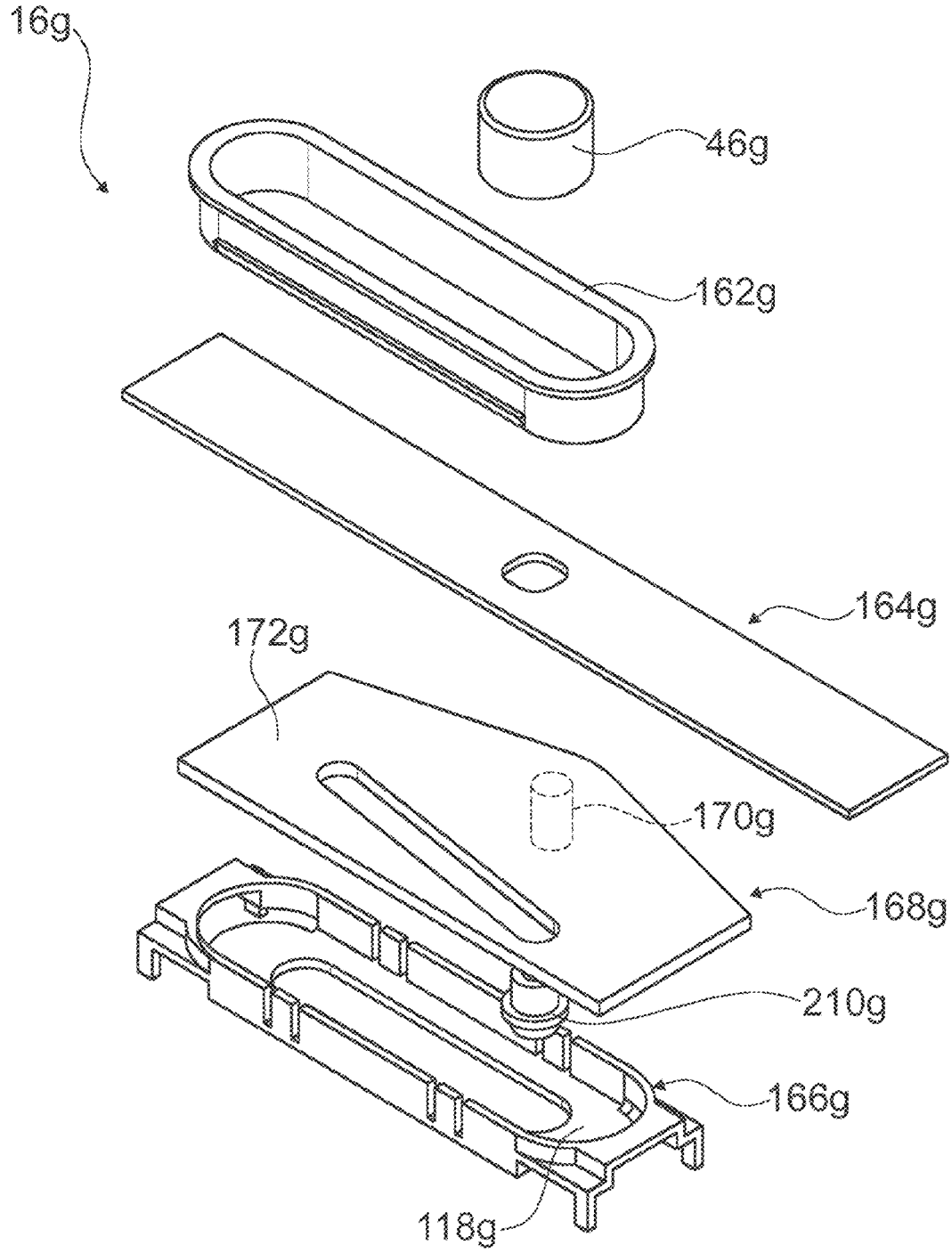

FIG. 33 shows another exemplary embodiment of a home appliance device. In this case a guiding element 118*g* of the manual actuator 16*g* is integrally implemented with an adapter connector 166*g* of the manual actuator 16*g*.

| Reference numerals | |
|---|---|
| 10 | inner liner |
| 12 | storage space |
| 14 | container |
| 16 | manual actuator |
| 18 | illumination unit |
| 20 | receptacle |
| 22 | frame |
| 24 | latching element |
| 26 | holding element |
| 28 | holding element |
| 30 | outer wall |
| 36 | open side |
| 38 | pass-through recess |
| 39 | further pass-through recess |
| 42 | closing plate |
| 44 | receiving recess |
| 46 | control element |
| 48 | protective inner barrier |
| 50 | protective inner barrier |
| 52 | first compartment |
| 54 | second compartment |
| 56 | drainage channel |
| 60 | opening |
| 62 | home appliance |
| 64 | securing recess |
| 66 | holding recess |
| 70 | insert portion |
| 72 | holding portion |
| 76 | first module |
| 78 | second module |
| 80 | construction kit |
| 82 | insert |
| 84 | accommodation recess |
| 88 | fixing unit |
| 92 | fixing element |
| 94 | push-in direction |
| 96 | receiving opening |
| 98 | pass-through opening |
| 100 | opening direction |
| 102 | opening direction |
| 104 | assembly element |
| 106 | bearing element |
| 108 | pivot axis |
| 110 | elastic element |
| 112 | snap edge |
| 114 | lock-in position |
| 116 | lock-in position |
| 118 | guiding element |
| 120 | first direction |
| 122 | second direction |
| 124 | third direction |
| 126 | snap element |
| 128 | snap element |
| 130 | guiding chamfer |
| 132 | guiding chamfer |
| 138 | outer housing |
| 140 | door |
| 142 | first storage area |
| 144 | second storage area |
| 148 | cover |
| 150 | window |
| 152 | shell |
| 154 | coupling element |
| 156 | illumination device |
| 158 | illumination opening |
| 159 | illumination cover |
| 162 | subhousing |
| 164 | indicator element |
| 166 | adapter connector |

-continued

| Reference numerals | |
|---|---|
| 168 | direction transformation unit |
| 170 | link |
| 172 | transformation guiding element |
| 174 | guiding unit |
| 176 | pin |
| 178 | snap member |
| 180 | directing element |
| 182 | method step |
| 184 | method step |
| 186 | method step |
| 188 | base plate |
| 190 | guiding tunnel |
| 192 | latching hook |
| 194 | latching arm |
| 196 | insert element |
| 198 | notch |
| 200 | profile |
| 202 | first sidewall |
| 204 | second sidewall |
| 206 | drain |
| 208 | bolt |
| 210 | connection joint |
| 212 | further connection joint |

The invention claimed is:

1. A home appliance device or home appliance chiller device, comprising:

an inner liner defining a storage space;

a container disposed inside said storage space, said container having an interior and an opening for placing victuals into said interior, said container having a cover covering said opening and closing said container;

a manual actuator configured for moving said cover with respect to said opening and controlling an opening degree of said opening for adjusting humidity inside said container;

an illumination unit configured for illuminating said interior of said container; and a receptacle at least partly accommodating said manual actuator and said illumination unit.

2. The home appliance device according to claim 1, which further comprises a frame disposed inside said storage space, said receptacle being fixed to said frame.

3. The home appliance device according to claim 2, wherein said receptacle is detachably fixed to said frame.

4. The home appliance device according to claim 2, wherein:

said receptacle includes a deformable latch and holder having a higher degree of rigidity than said latch;

said latch and said holder being configured for fixing said receptacle to said frame.

5. The home appliance device according to claim 4, wherein said receptacle includes an outer wall at least partly implementing said latch.

6. The home appliance device according to claim 1, wherein said receptacle includes at least one side having an opening formed therein, and said manual actuator at least partly extends through said opening.

7. The home appliance device according to claim 6, wherein said receptacle includes at least one further side having at least one pass-through recess formed therein, and said manual actuator is at least partly accommodated in said at least one pass-through recess.

8. The home appliance device according to claim 6, which further comprises a closing plate configured for at least partly closing said at least one side of said receptacle having said opening formed therein.

9. The home appliance device according to claim 8, wherein said manual actuator has a movable control element, and said closing plate has a receiving recess formed therein being configured for at least partly receiving said movable control element of said manual actuator.

10. The home appliance device according to claim 9, wherein said control element is at least substantially flush with at least one surface of said closing plate.

11. The home appliance device according to claim 1, wherein said receptacle includes a protective inner barrier configured for at least substantially preventing moisture from entering into said illumination unit.

12. The home appliance device according to claim 11, wherein said receptacle includes at least a first compartment at least partly accommodating said illumination unit and a second compartment at least partly accommodating said manual actuator, said protective inner barrier at least partly separating said first and second compartments.

13. The home appliance device according to claim 11, wherein said protective inner barrier includes a drainage channel configured for collecting condensed water.

* * * * *